US010394170B2

(12) United States Patent
Furusawa

(10) Patent No.: US 10,394,170 B2
(45) Date of Patent: Aug. 27, 2019

(54) FUSER DEVICE AND IMAGE FORMING APPARATUS

(71) Applicant: Oki Data Corporation, Tokyo (JP)

(72) Inventor: Yasunori Furusawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/874,599

(22) Filed: Jan. 18, 2018

(65) Prior Publication Data

US 2018/0217542 A1 Aug. 2, 2018

(30) Foreign Application Priority Data

Jan. 31, 2017 (JP) ..... 2017-015579

(51) Int. Cl.
*G03G 15/20* (2006.01)

(52) U.S. Cl.
CPC ..... *G03G 15/2028* (2013.01); *G03G 15/206* (2013.01); *G03G 15/2064* (2013.01); *G03G 2215/2022* (2013.01)

(58) Field of Classification Search
CPC ..... G03G 15/2085; G03G 15/2089
See application file for complete search history.

(56) References Cited

U.S. PATENT DOCUMENTS

2011/0158716 A1* 6/2011 Fujiwara ..... G03G 15/2053 399/329
2011/0207045 A1* 8/2011 Hori ..... G03G 5/14734 430/109.3
2015/0093165 A1* 4/2015 Kondo ..... G03G 15/206 399/329

FOREIGN PATENT DOCUMENTS

JP 2004-286929 A 10/2004
JP 2015-1561 A 1/2015

* cited by examiner

*Primary Examiner* — Gregory H Curran
(74) *Attorney, Agent, or Firm* — Muncy, Geissler, Olds & Lowe, P.C.

(57) ABSTRACT

A fuser device carrying a medium includes a first rotation member that has flexibility, a second rotation member that is installed rotatable so as to carry the medium from an upstream side to a downstream side in the medium carrying direction in cooperation with the first rotation member while nipping the medium between the second rotation member and the first rotation member, and a first pressing member that has a first pressing face pressing the first rotation member toward the second rotation member while being positioned opposing the second rotation member through the first rotation member. The first pressing face has, at the most upstream side of the medium carrying direction, a pressure reducing part that reduces a pressing force of the first rotation member that is applied to the second rotation member.

13 Claims, 38 Drawing Sheets

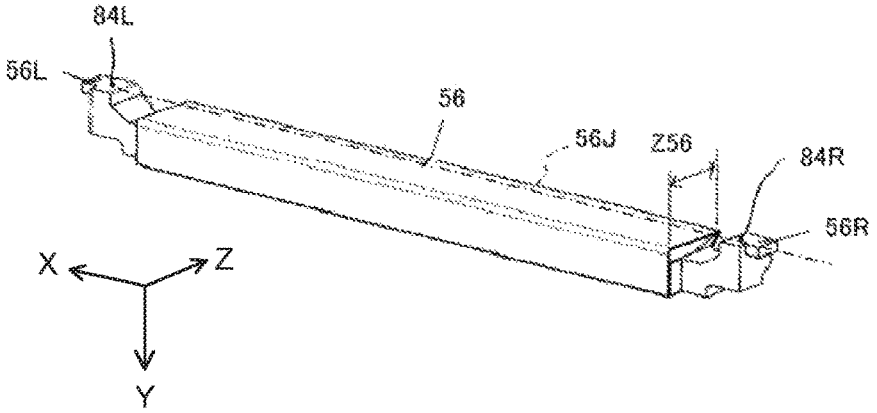
*Fig. 7B*
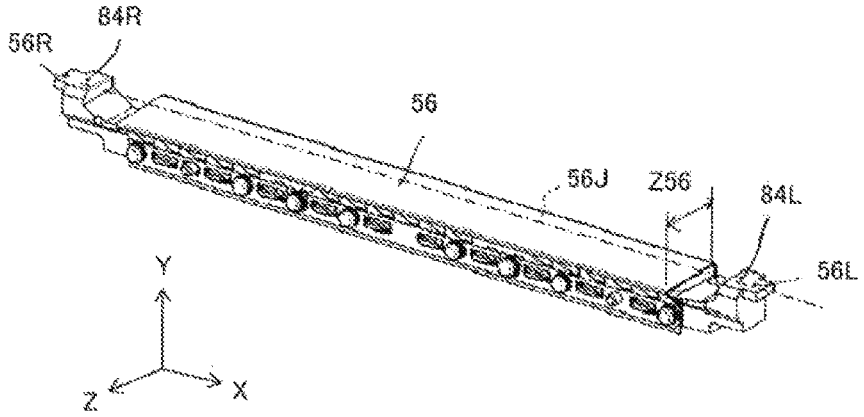

Normal Pressure Mode

Normal Pressure Mode

Reduced Pressure Mode

Reduced Pressure Mode

Reduced Pressure Mode
(Modified Example)

Reduced Pressure Mode
(Modified Example)

FUSER DEVICE AND IMAGE FORMING APPARATUS

TECHNOLOGY FIELD

This invention relates to a fuser device and an image forming apparatus provided with it.

BACKGROUND

Up to date, a fuser device that performs fusing of a developed image to a medium by applying heat and a pressure, and an image forming apparatus provided with it have been proposed (see Patent Document 1 for example).

RELATED ART

[Patent Doc. 1] JP Laid-Open Patent Publication 2004-286929

[Patent Doc. 2] JP Laid-Open Patent Publication 2015-1561

In such an image forming apparatus, a high quality image can be formed by performing a fusing operation with an appropriate level of pressure applied to a medium through a belt for example.

Therefore, it is desirable to offer a fuser device and an image forming apparatus that are suitable for realizing a higher quality image.

SUMMARY

A fuser device disclosed in the application, which carries a medium in a medium carrying direction, includes a first rotation member that has flexibility, a second rotation member that is installed rotatable so as to carry the medium from an upstream side to a downstream side in the medium carrying direction in cooperation with the first rotation member while nipping the medium between the second rotation member and the first rotation member, and a first pressing member that has a first pressing face pressing the first rotation member toward the second rotation member while being positioned opposing the second rotation member through the first rotation member, wherein the first pressing face has, at the most upstream side of the medium carrying direction, a pressure reducing part that reduces a pressing force of the first rotation member that is applied to the second rotation member.

An image forming apparatus disclosed in the application includes an image forming unit that performs an image forming process through which a latent image is developed with a developer, the developed image being formed on the medium, the fuser device discussed above with which the developed image is fused on the medium.

In embodiments of the fuser device and the image forming apparatus, the pressure reducing part is provided in which the first pressing face of the first pressing member reduces the pressing force of the first rotation member that is applied to the second rotation member. Accordingly, a nip pressure at an initial stage of a fusing operation is relaxed.

A fuser device and an image forming apparatus as embodiments of this disclosure are suitable for realizing a higher quality image.

BRIEF DESCRIPTION OF THE DRAWINGS

FIG. 7A is a perspective view showing the external appearance of another member of the fuser device shown in FIG. 4.

FIG. 7B is another perspective view showing the external appearance of another member of the fuser device shown in FIG. 4.

DETAILED DESCRIPTION OF PREFERRED EMBODIMENTS

Figure 1A:
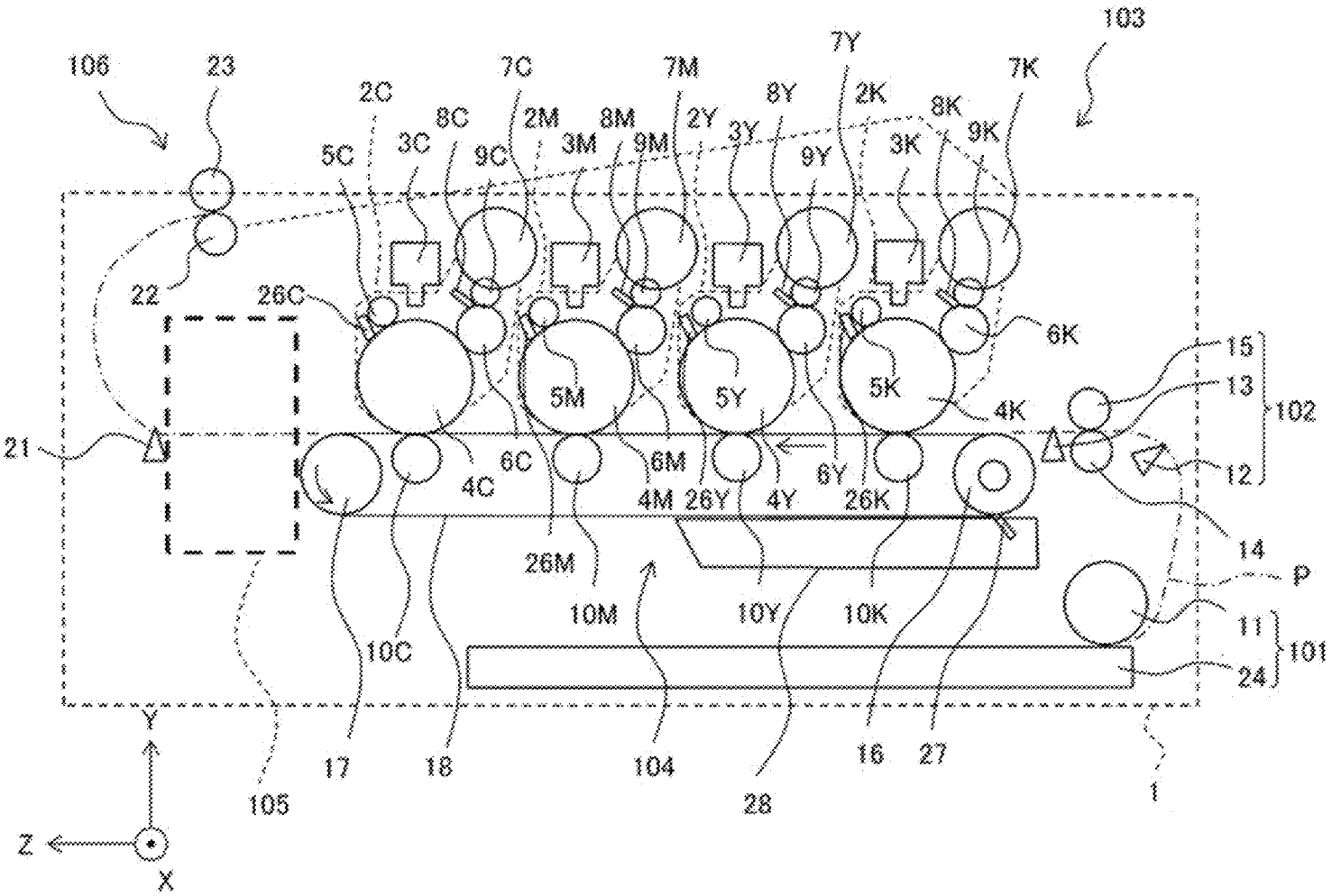
FIG. 1A is a schematic diagram showing an overall configuration example of an image forming apparatus of the first embodiment of this invention.

Below, embodiments of this invention are explained in detail referring to drawings. Note that the following explanation is a specific example of this invention, and this invention is not limited to the following modes. Also, this invention is not limited to the dispositions, dimensions, or dimension ratios of the individual components shown in the drawings. The explanation is given in the following order.

1. First embodiment: A fuser device where a fuser belt and a pressure application belt are disposed opposing each other so as to form a nip part, and an image forming apparatus provided with it.
2. First modification of the first embodiment.
3. Second modification of the first embodiment.
4. Second embodiment: A fuser device where a fuser belt and a pressure application roller are disposed opposing each other so as to form a nip part.
5. Other modifications.

1. First Embodiment

Outline Configuration of the Image forming Apparatus 1

Figure 1B:
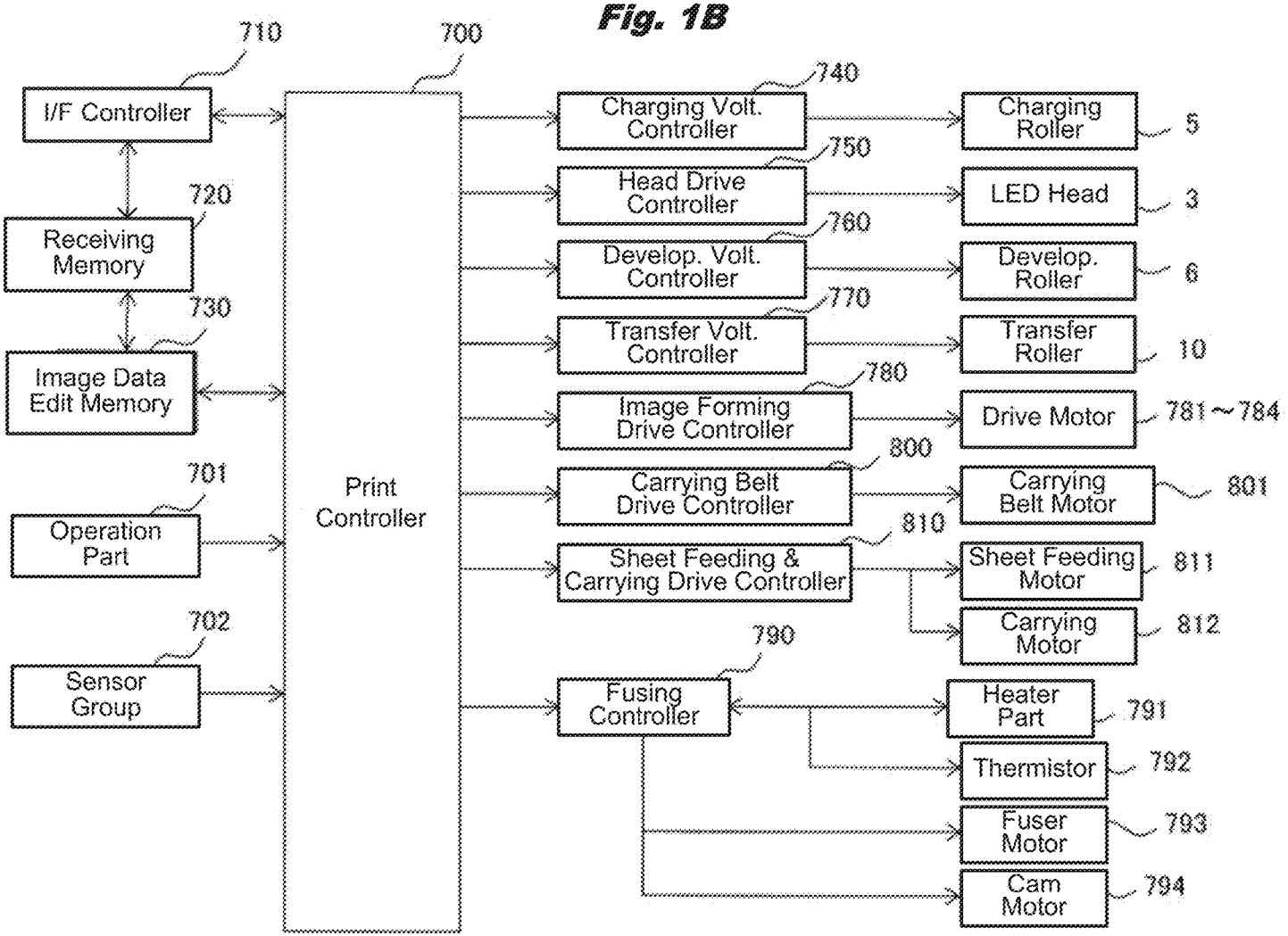
FIG. 1B is a block diagram schematically showing an internal configuration example of the image forming apparatus shown in FIG. 1A.

FIG. 1A is a schematic diagram showing an overall configuration example of an image forming apparatus 1 having a fuser device 105 of the first embodiment of this invention mounted. FIG. 1B is a block diagram corresponding to the internal configuration of the image forming apparatus 1 shown in FIG. 1A. The image forming apparatus 1 is, for example, an electrophotographic printer that forms an image (a color image for example) on a recording medium (also called a print medium or a transfer material) such as a sheet of paper. Note that in this specification, the direction perpendicular to the recording medium carrying direction (the X-axis direction perpendicular to the plane of the page in FIG. 1A) is called the width direction. Also, as mentioned below, the direction the recording medium is carried inside the fuser device 105 is denoted as the Z-axis direction, and the height direction perpendicular to both the X-axis direction and the Z-axis direction is denoted as the Y-axis direction. Note that the "recording medium" corresponds to a specific example of the "medium" of this invention.

The image forming apparatus 1 is provided with, inside its chassis for example, a sheet feeding part 101, a medium carrying part 102, an image forming part 103, a transfer part 104, a fuser device 105, and an ejection part 106 for example.

Sheet feeding part 101: The sheet feeding part 101 has, for example, a sheet cassette (a sheet feeding tray) 24 and a sheet feeding roller 11. The sheet cassette 24 accommodates the recording medium. The sheet feeding roller 11 is a member that extracts one piece of the recording medium at a time from the sheet cassette 24 and supplies the recording medium to the medium carrying part 102.

Medium Carrying Part 102:

The medium carrying part 102 has, in the order from the upstream side, a position sensor 12, a pair of carrying rollers 14 and 15 disposed opposing each other, and a position sensor 13. The position sensors 12 and 13 each detect the position of the recording medium progressing on a carrying route P. The pair of carrying rollers 14 and 15 carry the recording medium supplied by the sheet feeding roller 11 to the image forming part 103 in the downstream side.

Image Forming Part 103:

The image forming part 103 forms a toner image (a developer image), and the transfer part 104 transfers the toner image formed in the image forming part 103 to the recording medium. The image forming part 103 has, for example, four image forming units 2K, 2Y, 2M, and 2C. The image forming units 2K, 2Y, 2M, and 2C have LED (Light Emitting Diode) heads 3K, 3Y, 3M, and 3C, photosensitive drums 4K, 4Y, 4M, and 4C, charging rollers 5K, 5Y, 5M, and 5C, development rollers 6K, 6Y, 6M, and 6C, toner tanks 7K, 7Y, 7M, and 7C, development blades 8K, 8Y, 8M, and 8C, toner supply sponge rollers 9K, 9Y, 9M, and 9C, and photosensitive blades 26K, 26Y, 26M, and 26C, respectively.

The LED heads 3K, 3Y, 3M, and 3C expose the surfaces of the photosensitive drums 4K, 4Y, 4M, and 4C opposing them, respectively, and form electrostatic latent images on the surfaces of the photosensitive drums 4K, 4Y, 4M, and 4C, respectively.

Each of the photosensitive drums 4K, 4Y, 4M, and 4C is a columnar member that carries the electrostatic latent image on its surface (surface layer part), and is configured using a photosensitive body (such as an organic photosensitive body).

The charging rollers 5K, 5Y, 5M, and 5C are members (charging members) that charge the surface (surface layer part) of the photosensitive drums 4K, 4Y, 4M, and 4C, respectively, and are disposed so as to be in contact with the surface (circumferential face) of the photosensitive drums 4K, 4Y, 4M, and 4C, respectively.

The development rollers 6K, 6Y, 6M, and 6C are members that carry toner on their surfaces to develop the electrostatic latent images, and are disposed so as to be in contact with the surface (circumferential face) of the photosensitive drums 4K, 4Y, 4M, and 4C, respectively.

Each of the toner tanks 7K, 7Y, 7M, and 7C is a container that accommodates toner inside it, and has a toner ejection port on its lower part.

The development blades 8K, 8Y, 8M, and 8C are toner regulating members that form a layer made of toner (toner layer) on the surface of the rotating development rollers 6K, 6Y, 6M, and 6C, respectively, and also regulate (control/adjust) the thickness of the toner layer. The development blades 8K, 8Y, 8M, and 8C are plate-shaped elastic members (leaf springs) made of stainless steel for example, and the tip part of the plate-shaped elastic members is disposed in the vicinity of the surface of the development rollers 6K, 6Y, 6M, and 6C, respectively.

The toner supply sponge rollers 9K, 9Y, 9M, and 9C are members (supply members) for supplying toner to the development rollers 6K, 6Y, 6M, and 6C, respectively, and are disposed so as to be in contact with the surface (circumferential face) of the development rollers 6K, 6Y, 6M, and 6C, respectively.

The photosensitive blades 26K, 26Y, 26M, and 26C are cleaning members that clean the surface of the photosensitive drums 4K, 4Y, 4M, and 4C, respectively, by scraping off toner remaining on the surface (surface part) of the photosensitive drums 4K, 4Y, 4M, and 4C, respectively. The photosensitive blades 26K, 26Y, 26M, and 26C are disposed so as to be in counter-contact with the surface of the photosensitive drums 4K, 4Y, 4M, and 4C (to protrude in the opposite direction of the rotation direction of the photosensitive drums 4K, 4Y, 4M, and 4C), respectively. The photosensitive blades 26K, 26Y, 26M, and 26C are configured of, for example, an elastic body such as polyurethane rubber.

Transfer Part 104:

The transfer part 104 has, for example, a carrying belt 18, a drive roller 17 that drives this carrying belt 18, a driven roller 16 that is driven by this drive roller 17, transfer rollers 10K, 10Y, 10M, and 10C disposed opposing the photosensitive drums 4K, 4Y, 4M, and 4C, respectively through the carrying belt 18, a belt blade 27, and a waste toner box 28.

The carrying belt 18 is, for example, an endless elastic belt made of a resin material such as polyimide resin, stretched by the drive roller 17, the driven roller 16, and the transfer rollers 10K, 10Y, 10M, and 10C, and is designed to rotate cyclically in the direction of an arrow in FIG. 1A. The drive roller 17 drives the carrying belt 18 by a drive force from a carrying belt motor 801 (mentioned below). The transfer rollers 10K, 10Y, 10M, and 10C are members for electrostatically transferring the toner images formed inside the image forming units 2K, 2Y, 2M, and 2C onto the recording medium while carrying the recording medium in the carrying direction. The transfer rollers 10K, 10Y, 10M, and 10C are, for example, configured of a foamed semiconductive elastic rubber material. The drive roller 17, the driven roller 16, and the transfer rollers 10K, 10Y, 10M, and 10C are rotatable members of an approximate columnar shape extending laterally in the perpendicular direction to the plane of the page. The belt blade 27 is a member for cleaning the carrying belt 18 by scraping off waste toner remaining on the surface, and the waste toner box 28 is for recovering and storing the waste toner scraped off by the belt blade 27.

Fuser Device 105:

The fuser device 105 is a member for fusing the toner image onto the recording medium by applying heat and a pressure to the toner image transferred onto the recording medium carried from the transfer part 104. The fuser device 105 has a heater part 791, a thermistor 792, a fuser motor 793, and a cam motor 794. The heater part 791 includes heaters 50B, 50F, and 55L (all mentioned below). The fuser device 105 is described in detail below.

Ejection Part 106:

The ejection part 106 has a position sensor 21, and ejection rollers 22 and 23 disposed opposing each other. The position sensor 21 detects the position of the recording medium that is ejected from the fuser device 105 and progresses on the carrying route P. The ejection rollers 22 and 23 eject, to the outside, the recording medium ejected from the fuser device 105.

The image forming apparatus 1 is provided with, as shown in FIG. 1B, a print controller 700, an I/F controller 710, a receiving memory 720, an image data editing memory 730, an operation part 701, and a sensor group 702. The image forming apparatus 1 is further provided with a charging voltage controller 740, a head drive controller 750, a development voltage controller 760, a transfer voltage controller 770, an image forming drive controller 780, a fusing controller 790, a carrying belt drive controller 800, and a sheet feeding and carrying drive controller 810 that receive respective instructions from the print controller 700.

The print controller 700 is configured of a microprocessor, ROM, RAM, an input/output port, etc., and controls the whole processing operation in the image forming apparatus 1 by performing a predetermined program for example. Specifically, the print controller 700 receives print data and control commands from the I/F controller 710 and takes the total control of the charging voltage controller 740, the head drive controller 750, the development voltage controller 760, the transfer voltage controller 770, the image forming drive controller 780, the fusing controller 790, the carrying belt drive controller 800, and the sheet feeding and carrying drive controller 810 to perform the print operation.

The I/F controller 710 receives print data and control commands from an external device such as a personal computer (PC) or sends a signal concerning the status of the image forming apparatus 1.

The receiving memory 720 temporarily stores print data that came from an external device such as a PC through the I/F controller 710.

The image data editing memory 730 receives the print data stored in the receiving memory 720 and stores image data made by editing the print data.

The operation part 701 has, for example, an LED lamp for displaying information such as the status of the image forming apparatus 1, and an input part (buttons or a touch panel) for a user to give instructions to the image forming apparatus.

The sensor group 702 includes various kinds of sensors that monitor the operation status of the image forming apparatus 1, such as the position sensors 12, 13, and 21 that detect the position of the recording medium, a temperature sensor 29 that detects temperature inside the image forming apparatus 1, and a print density sensor 30 for example.

According to an instruction of the print controller 700, the charging voltage controller 740 performs control so as to apply a charging voltage to the charging rollers 5 (5K, 5Y, 5M, and 5C) to charge the surfaces of the photosensitive drums 4 (4K, 4Y, 4M, and 4C).

The head drive controller 750 controls an exposure operation by the LED heads 3 (3K, 3Y, 3M, and 3C) according to the image data stored in the image data editing memory 730.

According to an instruction of the print controller 700, the development voltage controller 760 performs control so as to apply a development voltage to the development rollers 6 (6K, 6Y, 6M, and 6C) to develop the electrostatic latent images formed on the surfaces of the photosensitive drums 4 (4K, 4Y, 4M, and 4C) with toner.

According to an instruction of the print controller 700, the transfer voltage controller 770 performs control so as to apply a transfer voltage to the transfer rollers 10 (10K, 10Y, 10M, and 10C) to transfer the toner image to the recording medium.

According to an instruction of the print controller 700, the image forming drive controller 780 performs the drive control of the drive motors 781-784. The drive motors 781-784 perform rotational drive of the photosensitive drums 4 (4K, 4Y, 4M, and 4C), the charging rollers 5 (5K, 5Y, 5M, and 5C), and the development rollers 6 (6K, 6Y, 6M, and 6C).

According to an instruction of the print controller 700, the fusing controller 790 controls the fusing operation of the fuser device 105. Specifically, it controls the voltage applied to the heater part 791. Based on the temperature of the fuser device 105 measured by the thermistor 792, the fusing controller 790 performs the on/off control of the voltage applied to the heater part 791. The fusing controller 790 also controls the operations of the fuser motor 793 and the cam motor 794.

According to an instruction of the print controller 700, the carrying belt drive controller 800 controls the operation of the carrying belt motor 801 installed in the image forming apparatus 1. The carrying belt motor 801 drives the carrying belt 18.

According to an instruction of the print controller 700, the sheet feeding and carrying drive controller 810 controls the operations of the sheet feeding motor 811 and the carrying motor 812 installed in the image forming apparatus 1.

Figure 2A:
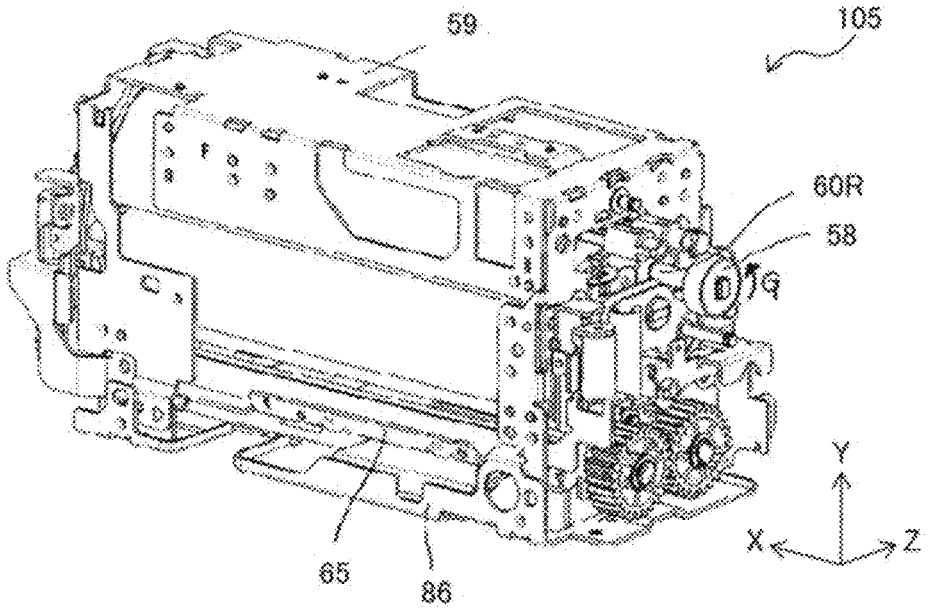
FIG. 2A is a perspective view showing an enlarged external appearance of a fuser device shown in FIG. 1A.
Figure 2B:
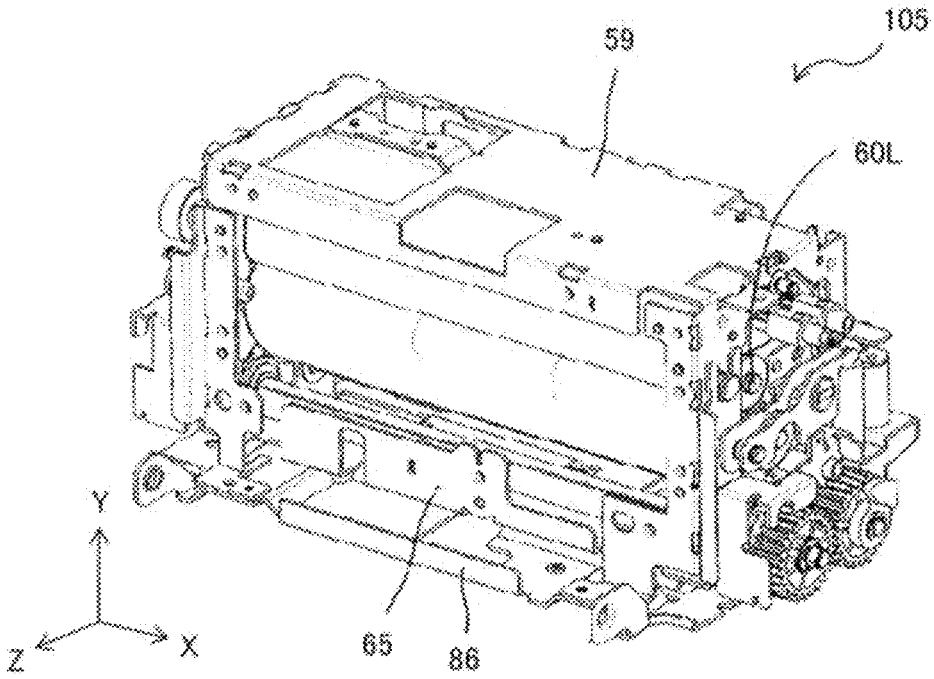
FIG. 2B is another perspective view showing an enlarged external appearance of the fuser device shown in FIG. 1A.
Figure 3A:
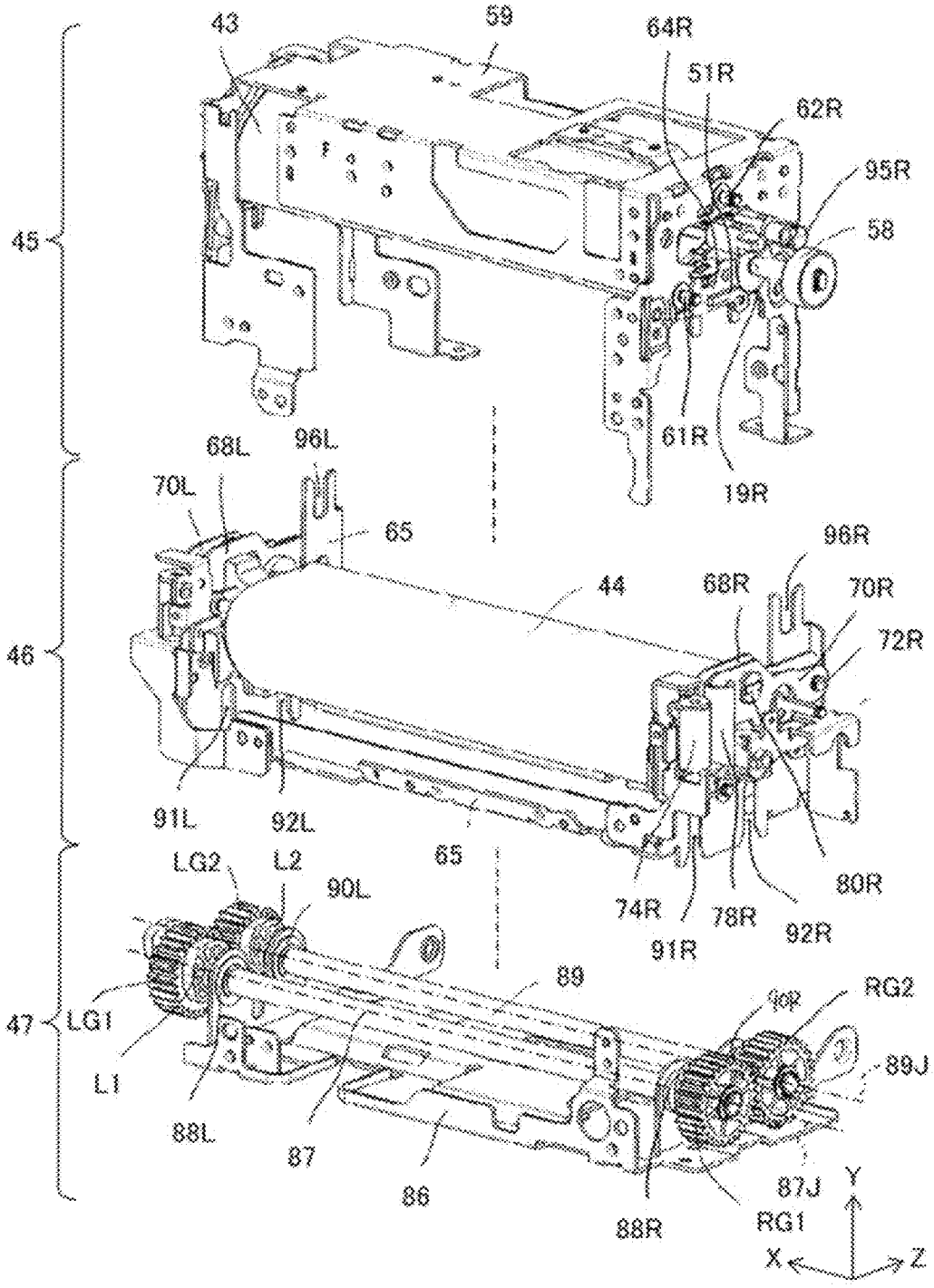
FIG. 3A is an exploded perspective view of the fuser device shown in FIG. 2A.
Figure 3B:
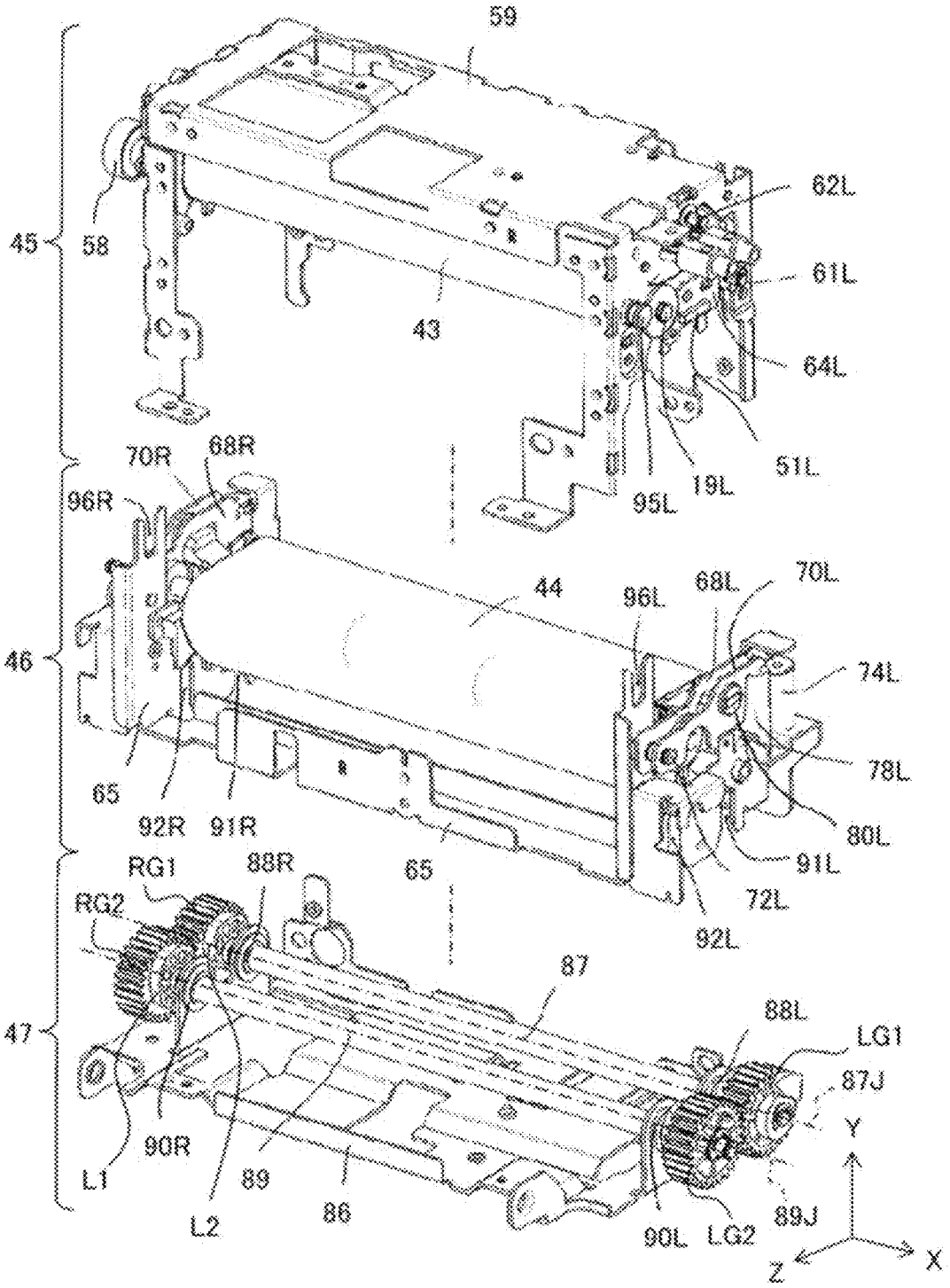
FIG. 3B is another exploded perspective view of the fuser device shown in FIG. 2B.
Figure 4:
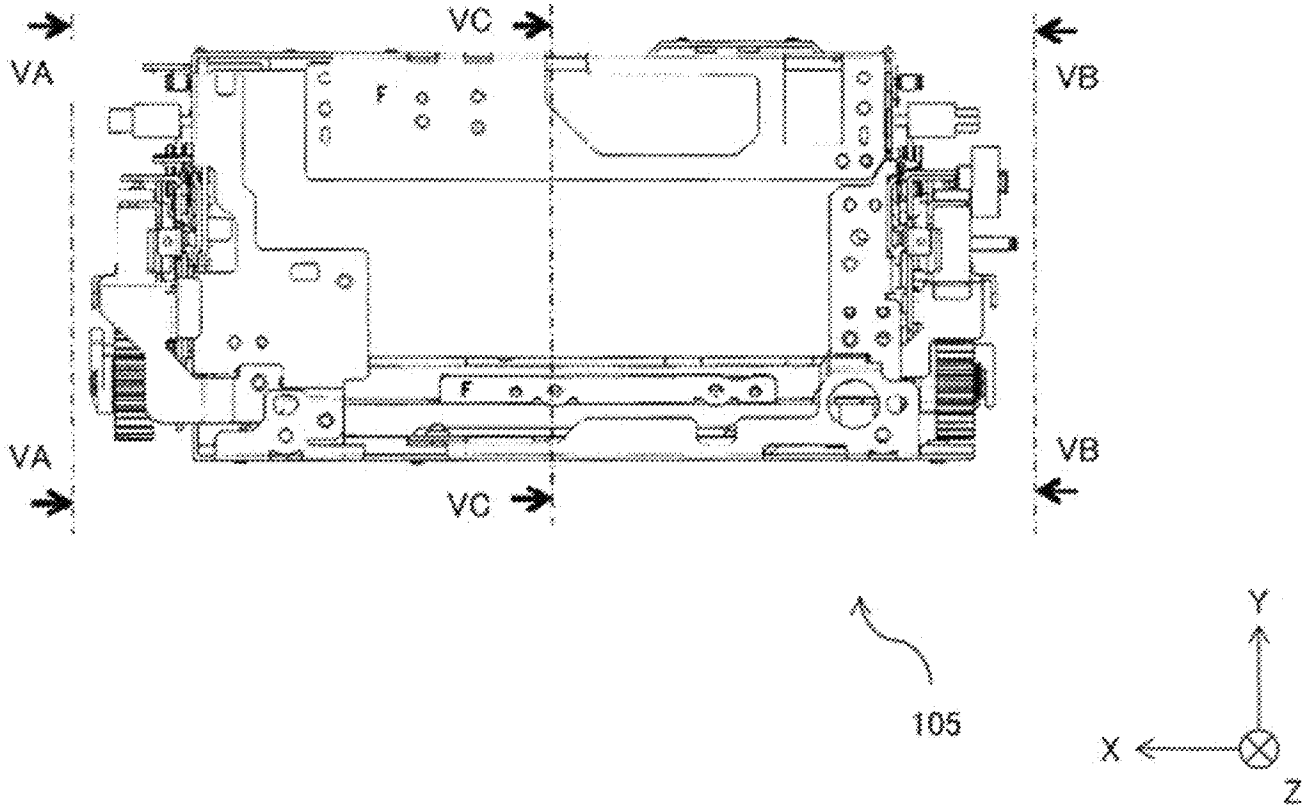
FIG. 4 is a front view showing the external appearance of the fuser device shown in FIG. 1A.
Figure 5A:
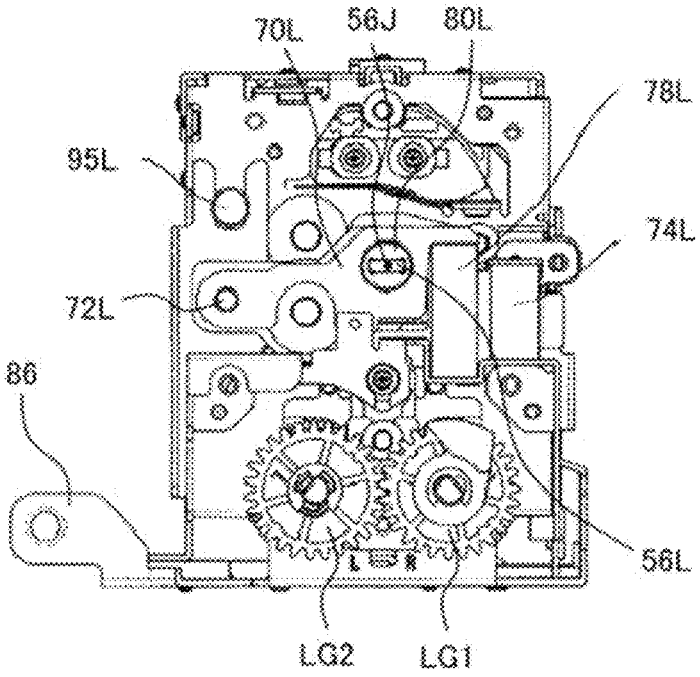
FIG. 5A is a cross-sectional view along a line VA-VA of the fuser device shown in FIG. 4.
Figure 5B:
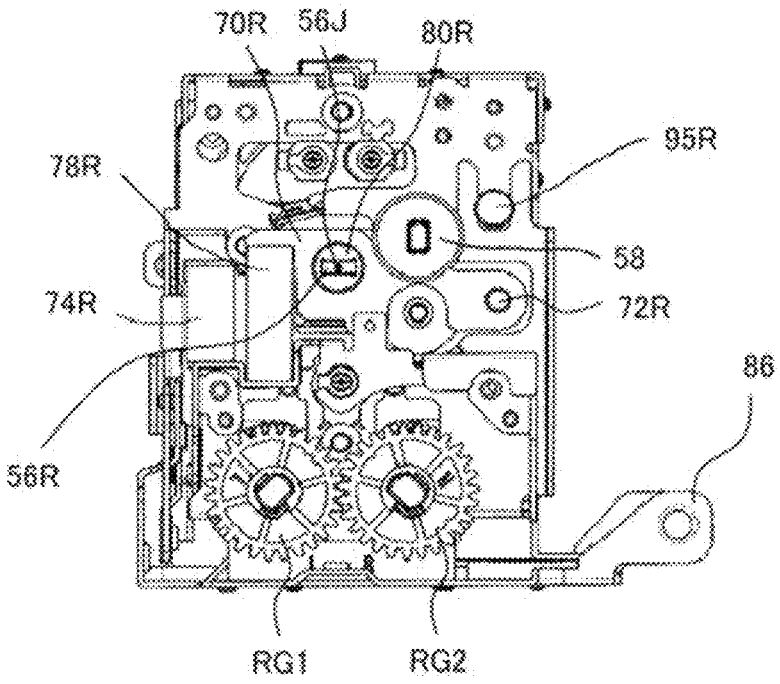
FIG. 5B is a cross-sectional view along a line VB-VB of the fuser device shown in FIG. 4.
Figure 5C:
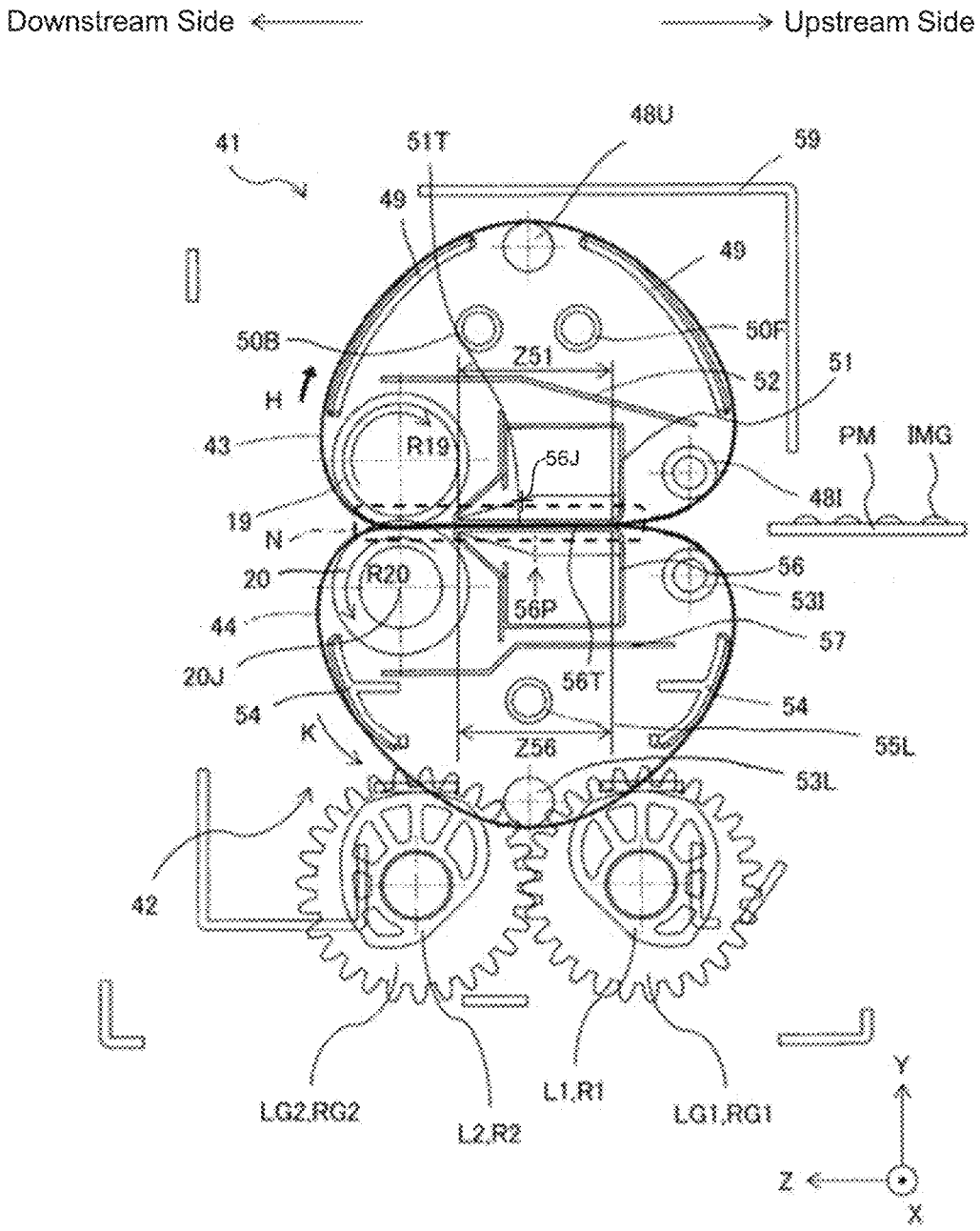
FIG. 5C is a cross-sectional view along a line VC-VC of the fuser device shown in FIG. 4.
Figure 6A:
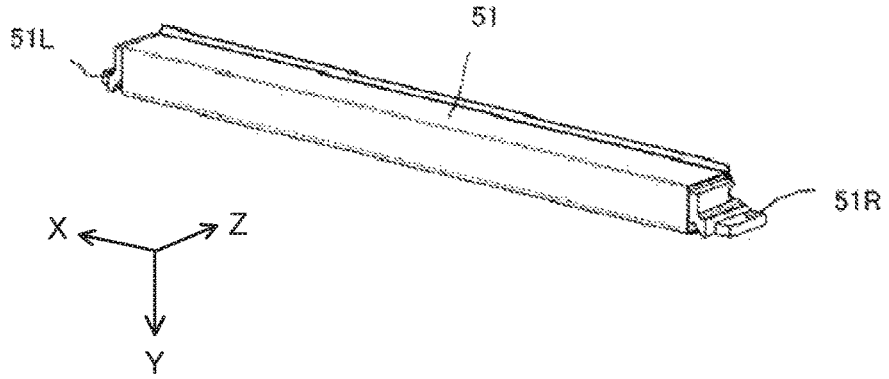
FIG. 6A is a perspective view showing the external appearance of a member of the fuser device shown in FIG. 4.
Figure 6B:
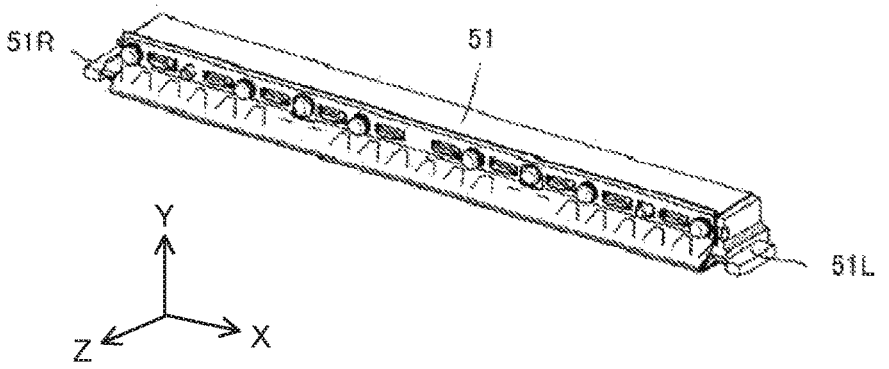
FIG. 6B is another perspective view showing the external appearance of a member of the fuser device shown in FIG. 4.

Configuration of the Fuser Device 105:

Next, referring to FIGS. 2A-12B, the detailed configuration of the fuser device 105 is explained. FIG. 2A is a perspective view showing the external appearance of the fuser device 105 seen from the upstream side of the recording medium carrying direction, and FIG. 2B is a perspective view showing the external appearance of the fuser device 105 seen from the downstream side of the recording medium carrying direction. FIG. 3A is an exploded perspective view of the fuser device 105 corresponding to FIG. 2A. FIG. 3B is an exploded perspective view of the fuser device 105 corresponding to FIG. 2B. FIG. 4 is a front view of the fuser device 105 seen from the upstream side of the recording medium carrying direction. FIGS. 5A-5C are cross-sectional views along lines VA-VA, VB-VB, and VC-VC shown in FIG. 4. FIGS. 6A and 6B are perspective views showing the external appearance of a fuser pad 51 (mentioned below). FIGS. 7A and 7B are perspective views showing the external appearance of a pressure application pad 56.

The fuser device 105 has an upper unit 45 positioned in the upper part, an intermediate unit 46 positioned in the middle, and a lower unit 47 positioned in the lower part in the Y-axis direction perpendicular to the Z-axis direction that is the recording medium carrying direction (see FIGS. 3A and 3B for example). The intermediate unit 46 is sandwiched between the upper unit 45 and the lower unit 47 in the Y-axis direction, and is held movable in the Y-axis direction by the upper unit 45 and the lower unit 47 between them.

Upper Unit 45:

The upper unit 45 is installed opposing the intermediate unit 46 in the Y-axis direction. The upper unit 45 has an upper chassis 59, and a fuser unit 41 installed in the upper chassis (FIG. 5C). The fuser unit 41 has, for example, a fuser belt 43 as a moving body, a fuser roller 19, a fuser pad 51, guide rollers 481 and 48U, two guide members 49, heaters 50B and 50F, and a reflective plate 52.

The fuser belt 43 is, for example, an endless elastic belt made of a resin material such as polyimide resin, or an endless elastic belt formed by forming silicone rubber on a metallic base material such as stainless steel, is stretched by the fuser roller 19, the guide rollers 481 and 48U, the guide members 49, etc., and cyclically rotates in the direction of an arrow H in FIG. 5C. The fuser belt 43 is in contact with a pressure application belt 44 (mentioned below) in a position opposing a pressure application unit 42 (mentioned below), and forms a nip part N spreading in the XZ plane (FIG. 5C). The fuser belt 43 rotates so as to carry the recording medium from the upstream side to the downstream side in the +Z direction in cooperation with the pressure application belt 44. Because the fuser belt 43 has flexibility, when it is pressed by the fuser pad 51 (described in more details later) to come into contact with the pressure application belt 44, it is deformed along the shape of a pressing face 51T (mentioned below) of the fuser pad 51. In the vicinity of the nip part N, the fuser belt 43 moves in the +Z direction. The fuser roller 19, the fuser pad 51, the guide rollers 481 and 48U, the guide members 49, the heaters 50B and 50F, and the reflective plate 52 are all disposed in a space surrounded by the fuser belt 43. Note that a recording medium PM enters from the upstream side (the right side on the page) and is carried toward the downstream side (the left side on the page) of the nip part N as shown in FIG. 5C. Here, a developer image IMG should preferably be transferred to the top face of the recording medium PM, that is, a face opposing the fuser belt 43. The fuser belt 43 is a specific example corresponding to the "second rotation member" of this invention.

The fuser roller 19 is in contact with the inner face of the fuser belt 43, and is installed rotatably in the direction of an arrow R19 for example. That is, the fuser roller 19 rotationally drives the fuser belt 43 in the direction of an arrow H by rotating in the direction of the arrow R19. During the operation of the fuser device 105, the fuser roller 19 opposes the pressure application roller 20 through the fuser belt 43 and the pressure application belt 44 (mentioned below). The fuser roller 19 is a rotation body of a columnar or cylindrical shape extending in the X-axis direction, and has rotation shaft end parts 19L and 19R at its ends. The rotation shaft end parts 19L and 19R of the fuser roller 19 are held in a freely rotatable manner relative to the upper chassis 59. The fuser roller 19 rotates by a drive force transmitted from the fuser motor 793 (FIG. 1B) through a drive gear 58 (FIGS. 2A and 5B) attached to the rotation shaft end part 19R.

The fuser pad 51 is, for example, a prism-shaped member (or columnar member) extending in the X-axis direction (FIGS. 6A and 6B) and is installed so as to press the fuser belt 43 in a direction (−Y direction) toward the pressure application unit 42 (mentioned below) in the intermediate unit 46. The fuser pad 51 includes the pressing face 51T extending in the X-axis direction (FIG. 5C). During the operation of the fuser device 105, the pressing face 51T of the fuser pad 51 opposes a pressing face 56T (mentioned below) of the pressure application pad 56 through the fuser belt 43 and the pressure application belt 44 (mentioned below). The fuser pad 51 has protruding parts 51L and 51R at both ends of the X-axis direction (FIGS. 6A and 6B). The protruding parts 51L and 51R are fixed to the upper chassis 59 through holding metal plates 64L and 64R, respectively (FIGS. 3A and 3B). Note that the fuser pad 51 is a specific example corresponding to the "second pressing member" of this invention.

The guide roller 481 is a rotation body of a columnar or cylindrical shape extending in the X-axis direction, and has rotation shaft end parts 61L and 61R at its both ends. The rotation shaft end parts 61L and 61R are held in a freely rotatable manner relative to the upper chassis 59. In the same manner, the guide roller 48U is a rotation body of a columnar or cylindrical shape extending in the X-axis direction, and has rotation shaft end parts 62L and 62R at its both ends. The rotation shaft end parts 62L and 62R are held in a freely rotatable manner relative to the upper chassis 59.

The two guide members 49 guide the fuser belt 43 through its circulating route, and is fixed to the upper chassis 59.

Each of the heaters 50B and 50F includes a heat generating body that generates heat for applying heat to the fuser belt 43, and the reflective plate 52 is a member that reflects heat generated in the heaters 50B and 50F toward the inner face of the fuser belt 43 positioned in the opposite side of the fuser roller 19 and the fuser pad 51. These heaters 50B and 50F and the reflective plate 52 are also fixed to the upper chassis 59.

Figure 8A:
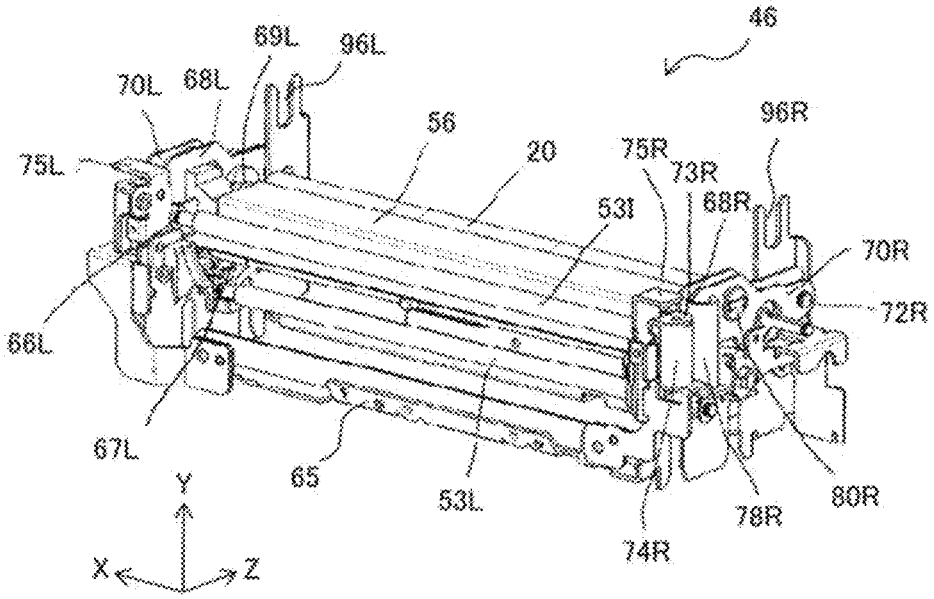
FIG. 8A is a perspective view showing the external appearance of an intermediate unit of the fuser device shown in FIG. 4.
Figure 8B:
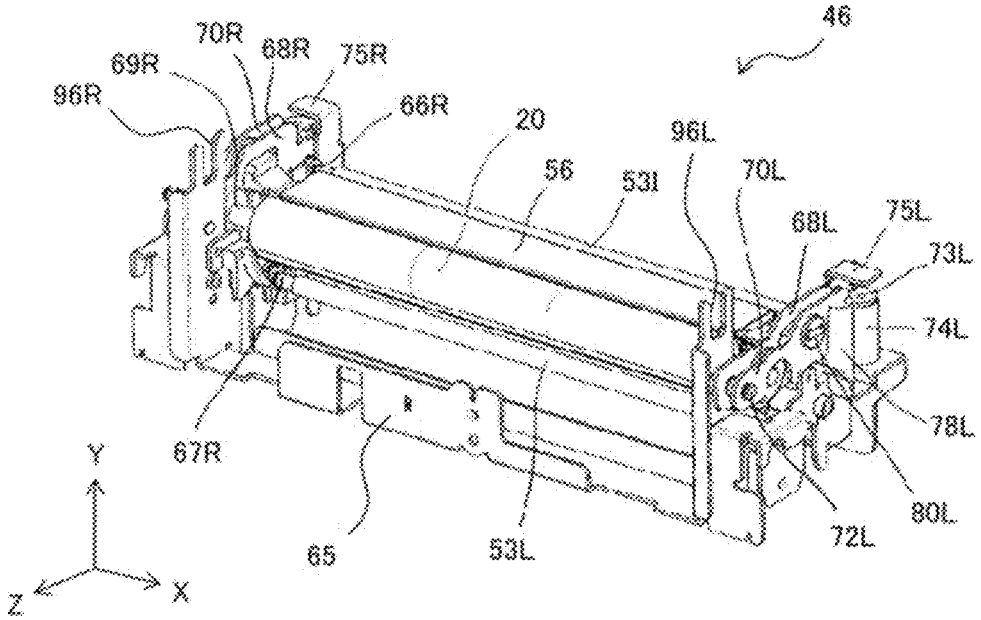
FIG. 8B is another perspective view showing the external appearance of the intermediate unit of the fuser device shown in FIG. 4.
Figure 9A:
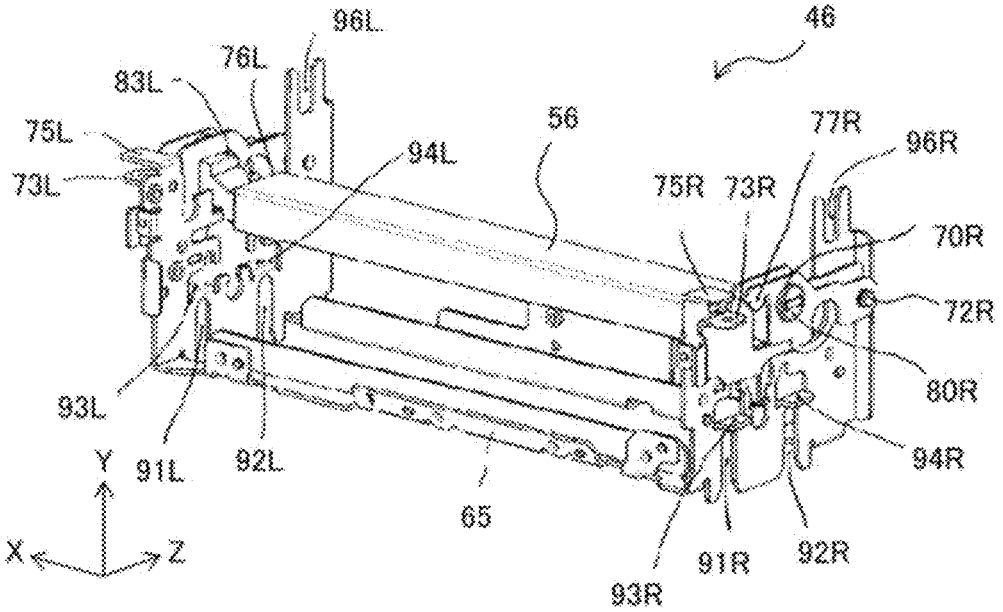
FIG. 9A is a perspective view showing part of components of the intermediate unit shown in FIG. 8A.
Figure 9B:
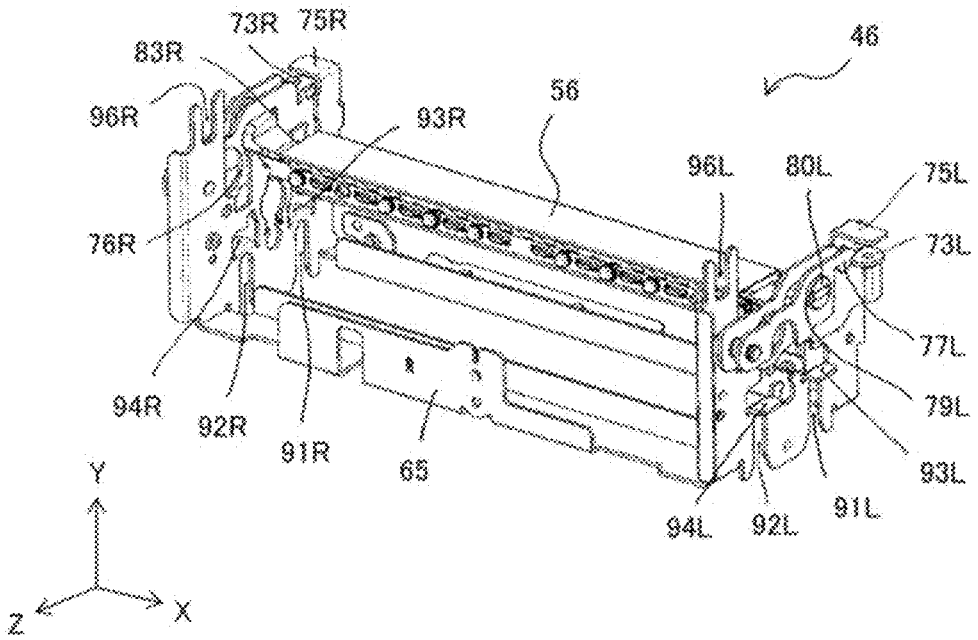
FIG. 9B is another perspective view showing part of components of the intermediate unit shown in FIG. 8B.

Intermediate Unit 46:

The intermediate unit 46 is installed so as to oppose the upper unit 45 in the Y-axis direction. The intermediate unit 46 has an intermediate chassis 65, and the pressure application unit 42 installed in the intermediate chassis 65 (FIG. 5C). The pressure application unit 42 has, for example, the pressure application belt 44, the pressure application roller 20, the pressure application pad 56, guide rollers 531 and 53L, two guide members 54, a heater 55L, and a reflective plate 57. Note that in order to clarify further the internal structure of the intermediate unit 46, the external appearance of the intermediate unit 46 in a state where the pressure application belt 44 and the guide members 54 are omitted is shown in FIGS. 8A and 8B. Furthermore, the external appearance of the intermediate unit 46 in a state where the pressure application roller 20 and the guide rollers 531 and 53L are also omitted is shown in FIGS. 9A and 9B.

The pressure application belt 44 is, for example, an endless elastic belt made of a resin material such as polyimide resin, or an endless elastic belt made by forming silicone rubber etc. on a metallic base material such as stainless steel, is stretched by the pressure application roller 20, the guide rollers 531 and 53L, the guide members 54, etc., and cyclically rotates in the direction of an arrow K in FIG. 5C. The pressure application belt 44 is in contact with the fuser belt 43 in a position opposing the fuser unit 41, and forms the nip part N spreading in the XZ plane (FIG. 5C). Because the pressure application belt 44 has flexibility, when it is pressed by the pressure application pad 56 (mentioned below) to come into contact with the fuser belt 43, it is deformed along the shape of the pressing face 56T (mentioned below) of the pressure application pad 56 being deformed. In the vicinity of the nip part N, the pressure application belt 44 moves in the +Z direction in the same manner as the fuser belt 43. The pressure application roller 20, the pressure application pad 56, the guide rollers 531 and 53L, the guide members 54, the heater 55L, and the reflective plate 57 are all disposed in a space surrounded by the pressure application belt 44. The pressure application belt 44 is a specific example corresponding to the "first rotation member" of this invention.

The pressure application roller 20 is in contact with the inner face of the pressure application belt 44 and is installed rotatable in the direction of an arrow R20 for example. The pressure application roller 20 rotates following the fuser belt 43 together with the pressure application belt 44. The pressure application roller 20 is a columnar or cylindrical rotation body extending in the X-axis direction, and is supported by holding parts 76L and 76R of holding arms 68L and 68R at its both ends in a freely rotatable manner centering on a rotation shaft 20J (FIGS. 9A and 9B). The holding arms 68L and 68R are held in a freely rotatable manner relative to the intermediate chassis 65 centering on rotation shaft parts 72L and 72R installed on the intermediate chassis 65. Therefore, the position of the pressure application roller 20 relative to the pressure application belt 44 is changeable. Note that the rotation shaft parts 72L and 72R are protrusions, each having the external appearance of an approximate columnar shape extending in the X-axis direction. The rotation shaft part 72L is positioned on an extension of the rotation shaft part 72R in the X-axis direction.

Figure 10:
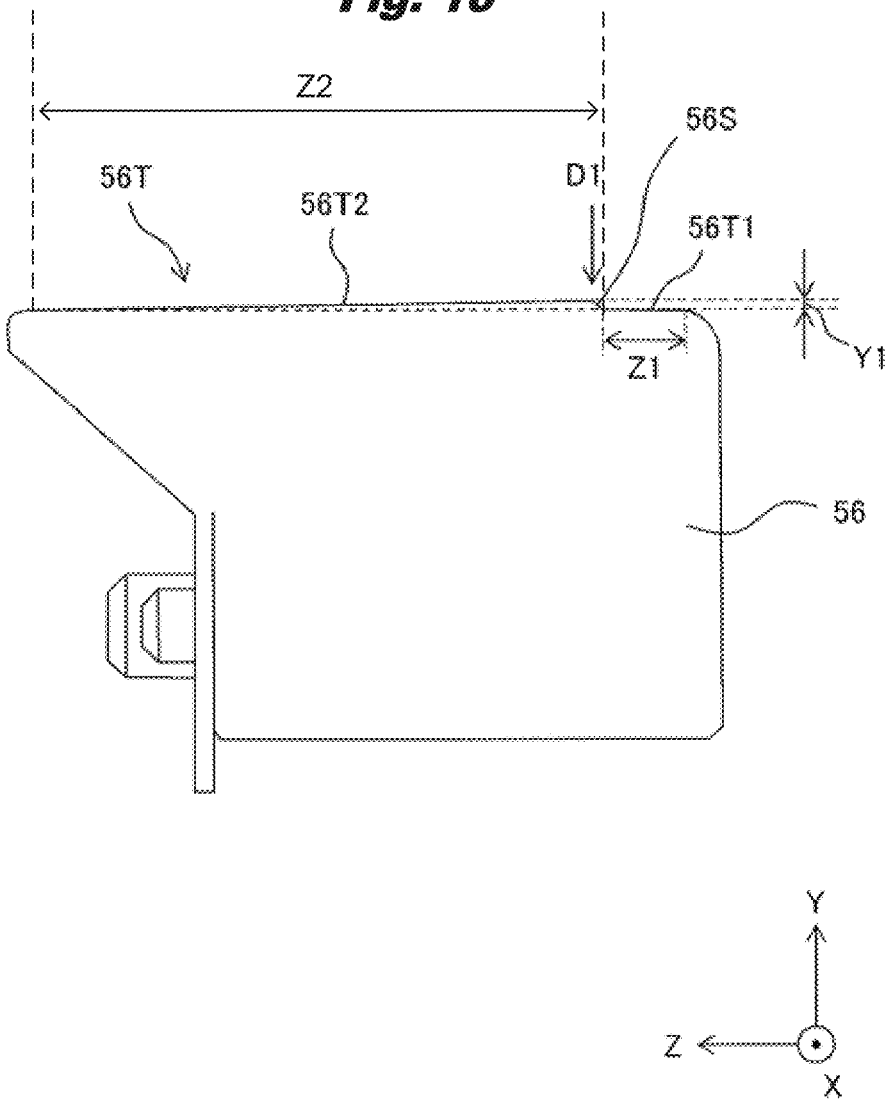
FIG. 10 is an enlarged cross-sectional view of a pressure application pad shown in FIG. 5C.

The pressure application pad 56 is, for example, a prism-shaped rigid member extending in the X-axis direction (FIGS. 7A and 7B), and is installed so as to press the pressure application belt 44 toward the fuser unit 41 in the upper unit 45 (in the +Y direction). Shown in FIG. 10 is an enlarged cross-sectional view of the pressure application pad 56. The pressure application pad 56 includes the pressing face 56T in contact with the pressure application belt 44 (FIG. 5C). The pressure application pad 56 can be made by covering the pressing face 56T of the rigid member with an elastic layer for example. During the operation of the fuser device 105, the pressing face 56T of the pressure application pad 56 opposes the pressing face 51T of the fuser pad 51 through the fuser belt 43 and the pressure application belt 44. The pressing face 56T has, in the most upstream side of the medium carrying direction (+Z direction), a pressure reducing part that reduces the pressing force of the pressure application belt 44 to the above-mentioned second rotation member. Specifically, as shown in FIG. 10, the pressing face 56T has a first part 56T1 positioned in its most upstream side in the medium carrying direction (+Z direction), and a second part 56T2 that is positioned in the downstream side of the first part 56T1 and protrudes more upward than the first part 56T1 toward the fuser belt 43 so as to form a step with the first part 56T1. That is, on the pressing face 56T, a step D1 between the first part 56T1 and the second part 56T2 exists. The first part 56T1 is installed in a position corresponding to a region of the nip part N where a peak of the nip pressure between the fuser belt 43 and the pressure application belt 44 tends to occur. The first part 56T1 and the second part 56T2 are connected by a sloped face 56S that is inclined relative to the first part 56T1 and the second part 56T2 for example. Note that in the example in FIG. 10, the first part 56T1 is a horizontal face spreading horizontally, and the second part 56T2 is a sloped face that is slightly inclined relative to the horizontal plane. The pressure application pad 56 is installed rotatably to holding arms 70L and 70R centering on a rotation shaft 56J along the X-axis that is substantially perpendicular to both the Z-axis direction and the Y-axis direction. That is, the pressure application pad 56 has protruding parts 56L and 56R at its both ends in the X-axis direction (FIGS. 7A and 7B), and those protruding parts 56L and 56R are held by the holding arms 70L and 70R in a freely rotatable manner centering on the rotation shaft 56J through bearings 80L and 80R, respectively. More specifically, the protruding parts 56L and 56R are fitted with bearings 80L and 80R, respectively, and the bearings 80L and 80R are inserted through openings installed on the holding arms 70L and 70R, respectively, and are held by the holding arms 70L and 70R in a freely rotatable manner centering on the rotation shaft 56J. Furthermore, the holding arms 70L and 70R are held in a freely rotatable manner relative to the intermediate chassis 65 centering on the rotation shaft parts 72L and 72R installed on the intermediate chassis 65, respectively. Therefore, the holding arms 70L and 70R holding the pressure application pad 56 and the holding arms 68L and 68R holding the pressure application roller 20 are next to each other in the X-axis direction, respectively, and rotate centering on the same rotation shaft part 72L or 72R within the YZ plane, respectively. Also, the protruding parts 56L and 56R include contact faces 84L and 84R that come into contact with edges 97L and 97R of penetration holes 83L and 83R mentioned below, respectively. Also, as shown in FIG. 10, a length Z1 along the carrying direction form the upstream side toward the downstream side (the Z-axis direction in FIG. 10) in the first part 56T1 should desirably be larger than the difference Y1 (that is, height of the step D1) between the first part 56T1 and the second part 56T2 in the thickness direction (the Y-axis direction) perpendicular to the carrying direction (Z1>Y1). Note that the pressure application pad 56 is a specific example corresponding to the "first pressing member" of this invention, and the pressing face 56T is a specific example corresponding to the "first pressing face" of this invention. For example, it is preferred that the difference Y1 and length Z1 are ranged as follow:

0 mm<Y1<1 mm 1 mm<Z1<6 mm.

In the Z-axis direction, the position of the rotation shaft 56J (the center position of the bearings 80L and 80R) should desirably be the same position with the center position 56P in the Z-axis direction on the pressing face 56T of the pressure application pad 56, or in the downstream side of the center position 56P (FIG. 5C). The reason is that in the fusing operation mentioned below, when switching from the separation mode to the normal pressure mode or the reduced pressure mode, the attitude of the pressing face 56T of the pressure application pad 56 relative to the pressing face 51T of the fuser pad 51 can be quickly made closer to a parallel state. As the result, variation of the nip pressure accompanying the attitude change is reduced, making it easy to obtain a more stable nip pressure. Also, it is believed that an even higher nip pressure can be obtained by positioning the rotation shaft 56J (the center position of the bearings 80L and 80R) in the downstream side of the center position 56P. Furthermore, the dimension Z56 of the pressure application pad 56 in the Z-axis direction should desirably be larger than the dimension Z51 of the fuser pad 51 in the Z-axis direction. The reason is that a more stable nip pressure can be easily obtained by increasing the length of the nip part N in Z-axis direction.

The guide roller 531 is a columnar or cylindrical rotation body extending in the X-axis direction, and its both ends have rotation shaft end parts 66L and 66R (FIGS. 8A and 8B). The rotation shaft end parts 66L and 66R are held in a freely rotatable manner relative to the intermediate chassis 65. In the same manner, the guide roller 53U is a columnar or cylindrical rotation body extending in the X-axis direction, and has rotation shaft end parts 67L and 67R at its both ends (FIGS. 8A and 8B). The rotation shaft end parts 67L and 67R are held in a freely rotatable manner relative to the intermediate chassis 65.

The two guide members 54 guide a route for the pressure application belt 44 to circulate, and is fixed to the intermediate chassis 65 for example.

The heater 55L includes a heat generating body that generates heat for applying heat to the pressure application belt 44, and the reflective plate 57 is a member that reflects heat generated in the heater 55L toward the inner face of the pressure application belt 44 positioned in the opposite side of the pressure application roller 20 and the pressure application pad 56. Because of the presence of the reflective plate 57, heat generated by the heater 55 is efficiently transmitted to the pressure application belt 44. These heater 55 and reflective plate 57 are also fixed to the intermediate chassis 65.

The intermediate unit 46 further has first bias members 74L and 74R and second bias members 78L and 78R. The first bias members 74L and 74R are members, each of which includes one end in contact with a stopper 73L or 73R that is part of the holding arm 68L or 68R, respectively, and the other end in contact with part of the intermediate chassis 65, and biases the stopper 73L or 73R away from the intermediate chassis 65. That is, the first bias members 74L and 74R are members that bias the holding arms 68L and 68R upward, respectively, so that the pressure application roller 20 approach the upper unit 45 along the Y-axis direction. Each of the second bias members 78L and 78R includes one end in contact with a fixed part 77L or 77R positioned at the opposite end part of the rotation shaft part 72L or 72R of the holding arm 70L or 70R, respectively (FIGS. 9A and 9B), and the other end in contact with part of the intermediate chassis 65. The second bias members 78L and 78R are members that bias the end parts of the holding arms 70L and 70R where the fixed parts 77L and 77R are installed, respectively, away from the intermediate chassis 65. That is, the second bias members 78L and 78R are members that bias the holding arms 70L and 70R upward, respectively, so that the pressure application pad 56 approaches the upper unit 45 along the Y-axis direction. Each of the first bias members 74L and 74R and the second bias members 78L and 78R is, for example, configured of a coil spring.

The intermediate unit 46 further has lock parts 75L and 75R that restrict the movement of the holding arms 68L and 68R toward the upper unit 45. The lock parts 75L and 75R are installed on the intermediate chassis 65 so as to lock the rotation of the holding arms 68L and 68R by coming into contact with the stoppers 73L and 73R.

Installed on the holding arms 68L and 68R are penetration holes 83L and 83R that include edges 97L and 97R, respectively, and the protruding parts 56L and 56R of the pressure application pad 56 penetrate the penetration holes 83L and 83R (see FIGS. 13B, 14B, 15B, and 16B). The holding arms 70L and 70R have the contact faces 84L and 84R come into contact with the edges 97L and 97R of the holding arms 68L and 68R, thereby restricting its movement toward the upper unit 45.

Figure 11:
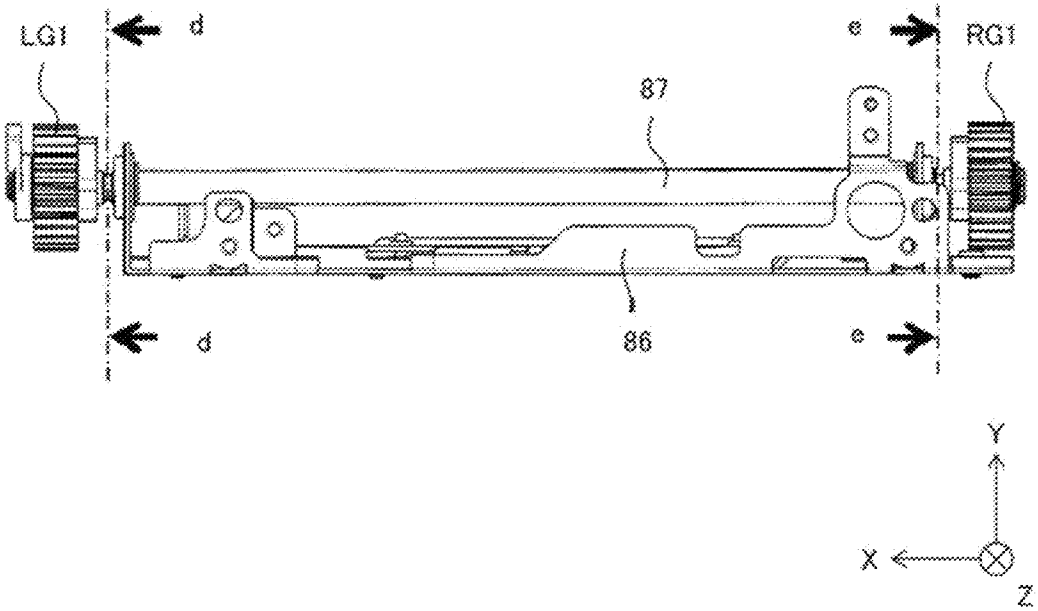
FIG. 11 is a front view showing the external appearance of a lower unit shown in FIG. 3A.
Figure 12A:
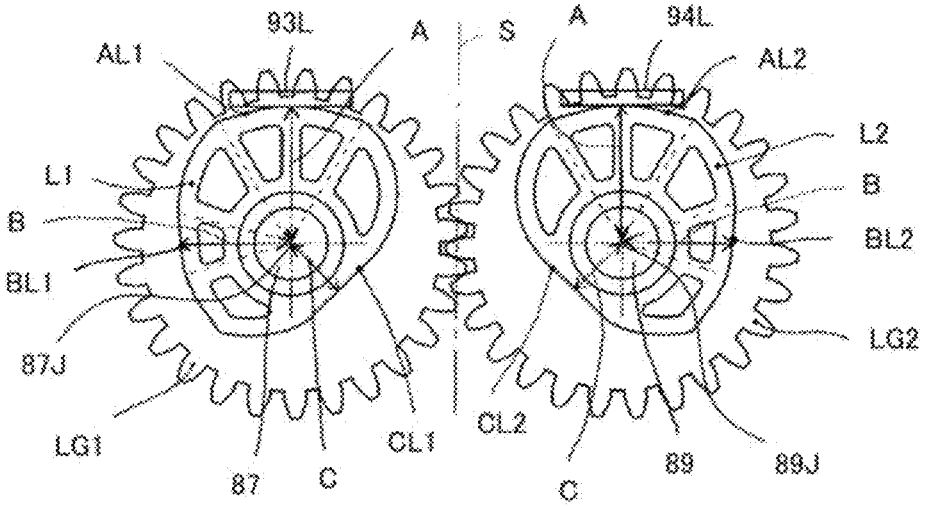
FIG. 12A is a side view of part of the fuser device shown in FIG. 11 seen from the direction of an arrow d (Normal pressure state).
Figure 12B:
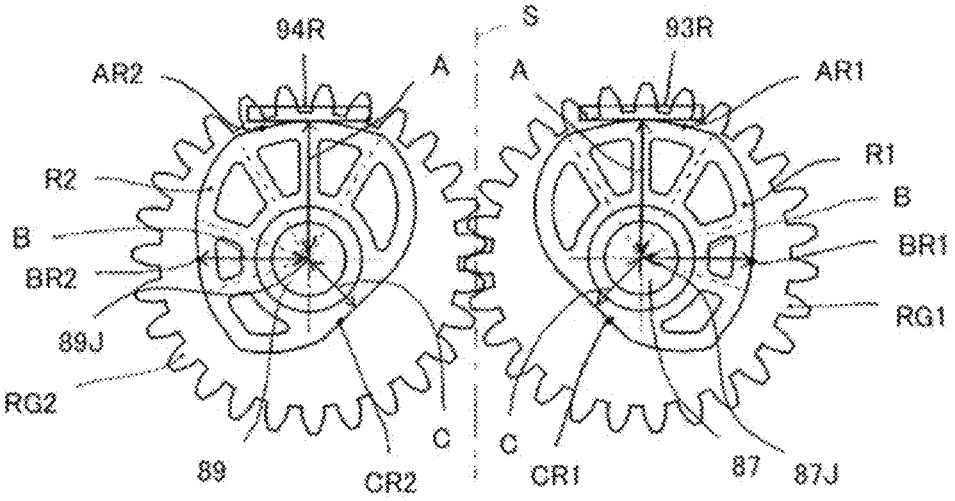
FIG. 12B is a side view of part of the fuser device shown in FIG. 11 seen from the direction of an arrow e (Normal pressure state).
Figure 13A:
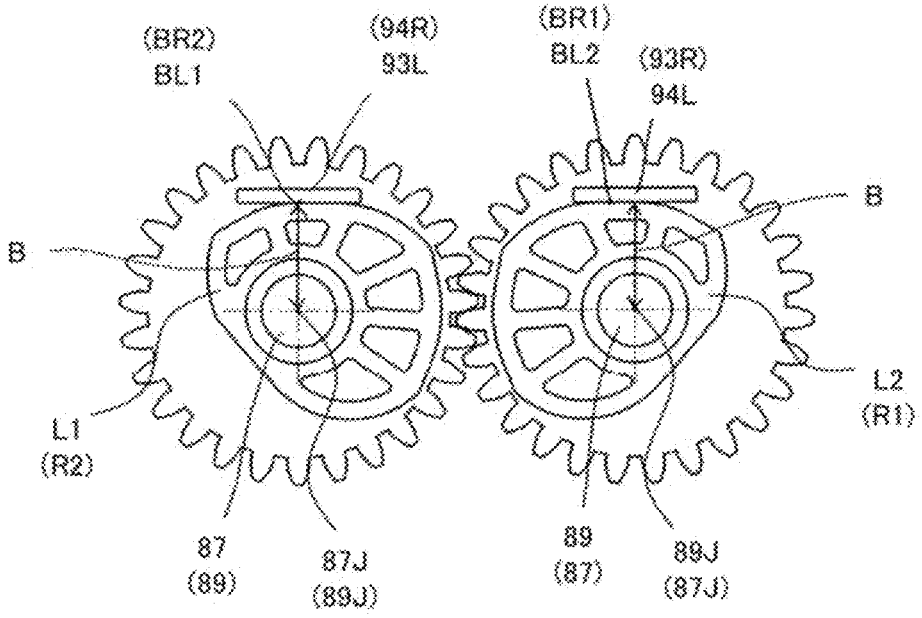
FIG. 13A is a side view of part of the fuser device shown in FIG. 11 seen from the direction of an arrow d (Reduced pressure state).
Figure 13B:
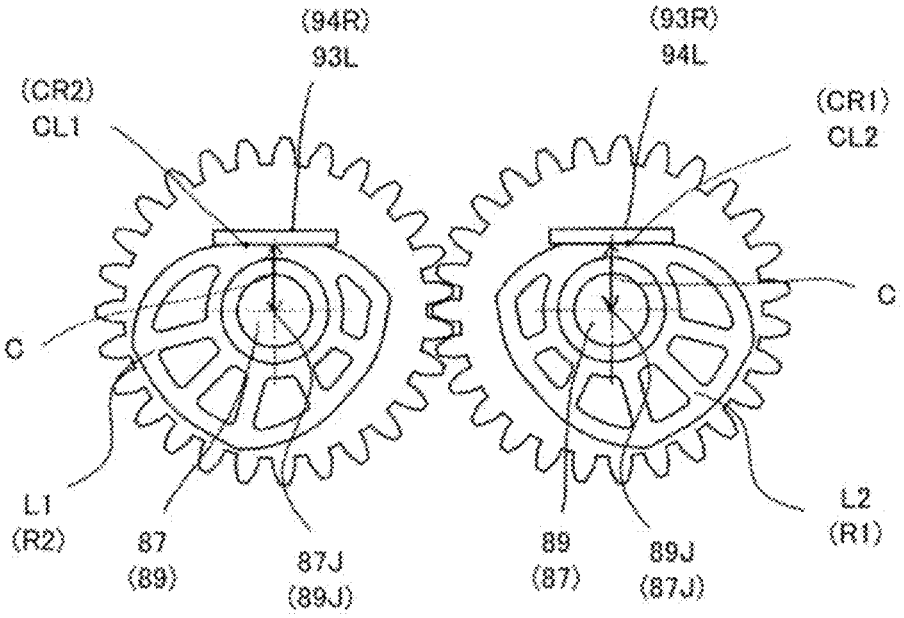
FIG. 13B is a side view of part of the fuser device shown in FIG. 11 seen from the direction of an arrow d (Separation state).

Lower Unit 47:

Referring further to FIGS. 11-13B in addition to FIGS. 1-9B, the detailed configuration of the lower unit 47 is explained. FIG. 11 is a front view of the external appearance of the lower unit 47 seen from the upstream side. FIGS. 12A and 12B are side views of part of the fuser device 105 in the normal pressure state seen from the direction of an arrow d and the direction of an arrow e shown in FIG. 11, respectively. FIGS. 13A and 13B are side views of part of the fuser device 105 in the reduced pressure state and the separation state, respectively, seen from the direction of an arrow d.

The lower unit 47 has a lower chassis 86, a first cam shaft 87, first supporting parts 88L and 88R, first cams L1 and R1, first cam gears LG1 and RG1, a second cam shaft 89, second supporting parts 90L and 90R, second cams L2 and R2, and second cam gears LG2 and RG2. The lower chassis 86 is fixed to the upper chassis 59 by screwing for example. The first cam shaft 87 and the second cam shaft 89 each extend in the X-axis direction next to each other in the Z-axis direction, and are each attached to the lower chassis 86 in a rotatable manner through the first supporting parts 88L and 88R and the second supporting parts 90L and 90R.

The first cam gear LG1 is installed at one end of the first cam shaft 87, and the first cam gear RG1 is installed at the other end of the first cam shaft 87. Also, the first cams L1 and R1 are fixed to the first cam shaft 87 between the first cam gear LG1 and the first cam gear RG1. For example, the first cam L1 is in contact with the first cam gear LG1, and the first cam R1 is in contact with the first cam gear RG1. The first cam shaft 87, the first cams L1 and R1, and the first cam gears LG1 and RG1 rotate as one unit centering on a shaft 87J extending in the X-axis direction.

The second cam gear LG2 is installed at one end of the second cam shaft 89, and the second cam gear RG2 is installed at the other end of the second cam shaft 89. Also, the second cams L2 and R2 are fixed to the second cam shaft 89 between the second cam gear LG2 and the second cam gear RG2. For example, the second cam L2 is in contact with the second cam gear LG2, and the second cam R2 is in contact with the second cam gear RG2. The second cam shaft 89, the second cams L2 and R2, and the second cam gears LG2 and RG2 integrally rotate centering on a shaft 89J extending in the X-axis direction.

Here, as shown in FIGS. 12A and 12B for example, the first cam L1 and the second cam L2 have a plane-symmetric relationship relative to a virtual center plane S parallel to the XY plane. Specifically, the first cam L1 includes cam faces AL1, BL1, and CL1, and the second cam L2 includes cam faces AL2, BL2, and CL2. The cam faces AL1, BL1, and CL1, and the cam faces AL2, BL2, and CL2 are in plane-symmetric positions relative to the center plane S, respectively. The same is true for the relationship between the first cam R1 and the second cam R2. That is, the first cam R1 and the second cam R2 has a plane-symmetric relationship relative to the virtual center plane S parallel to the XY plane. Specifically, the first cam R1 includes cam faces AR1, BR1, and CR1, and the second cam R2 includes cam faces AR2, BR2, and CR2. The cam faces AR1, BR1, and CR1, and the cam faces AR2, BR2, and CR2 are in plane-symmetric positions relative to the center plane S, respectively. Furthermore, the first cam L1 and the first cam R1 have shapes and sizes mutually overlapping in the X-axis direction. In the same manner, the second cam L2 and the second cam R2 have shapes and sizes mutually overlapping in the X-axis direction.

In the first cam L1, among the cam faces AL1, BL1, and CL1, the cam face AL1 is in a position at a distance A that is farthest from the shaft 87J of the first cam shaft 87. In the first cam R1, among the cam faces AR1, BR1, and CR1, the cam face AR1 is in a position at the distance A that is farthest from the shaft 87J of the first cam shaft 87. In the second cam L2, among the cam faces AL2, BL2, and CL2, the cam face AL2 is in a position at the distance A that is farthest from the shaft 89J of the second cam shaft 89. In the second cam R2, among the cam faces AR2, BR2, and CR2, the cam face AR2 is in a position at the distance A that is farthest from the shaft 89J of the second cam shaft 89.

Also, the cam faces BL1 and BR1 are in positions at a distance B from the shaft 87J, and the cam faces CL1 and CR1 are in positions at a distance C from the shaft 87J. Furthermore, the cam faces BL2 and BR2 are in positions at the distance B from the shaft 89J, and the cam faces CL2 and CR2 are in positions at the distance C from the shaft 89J.

At both ends in the X-axis direction of the intermediate chassis 65 of the intermediate unit 46, contact protrusion plates 93L, 93R, 94L, and 94R are installed. The contact protrusion plate 93L comes into contact with one of the cam faces AL1, BL1, and CL1 according to the rotational position of the first cam L1. The contact protrusion plate 93R comes into contact with one of the cam faces AR1, BR1, and CR1 according to the rotational position of the first cam R1. The contact protrusion plate 94L comes into contact with one of the cam faces AL2, BL2, and CL2 according to the rotational position of the second cam L2. The contact protrusion plate 94R comes into contact with one of the cam faces AR2, BR2, and CR2 according to the rotational position of the second cam R2.

Installed on the intermediate chassis 65 of the intermediate unit 46 are first slits 91L and 91R, second slits 92L and 92R, and third slits 96L and 96R, all extending in the Y-axis direction. Installed on the upper chassis 59 of the upper unit 45 are posts 95L and 95R. In the fuser device 105, the first cam shaft 87 is inserted to the first slits 91L and 91R, the second cam shaft 89 is inserted to the second slits 92L and 92R, and the posts 95L and 95R are inserted to the third slits 96L and 96R. The first cam shaft 87, the second cam shaft 89, and the posts 95L and 95R are guided in the Y-axis direction by the first slits 91L and 91R, the second slits 92L and 92R, and the third slits 96L and 96R, respectively.

As mentioned above, the contact protrusion plates 93L, 93R, 94L, and 94R are always in contact with the first cams L1 and R1 and the second cams L2 and R2 by the self-weight of the intermediate unit 46. Therefore, by the positions of the first cams L1 and R1 and the second cams L2 and R2 in the Y-axis direction changing accompanying their rotational motions, the intermediate chassis 65 moves up and down (moves in the Y-axis direction). For example, in a state where the cam faces AL1, AR1, AL2, and AR2 are in contact with the contact protrusion plates 93L, 93R, 94L, and 94R, respectively, the intermediate chassis 65 comes into the highest position, in a state where the cam faces CL1, CR1, CL2, and CR2 are in contact with the contact protrusion plates 93L, 93R, 94L, and 94R, respectively, the intermediate chassis 65 comes into the lowest position, and in a state where the cam faces BL1, BR1, BL2, and BR2 are in contact with the contact protrusion plates 93L, 93R, 94L, and 94R, respectively, the intermediate chassis 65 comes into an intermediate height position. The reason is that the distance A is larger than any of the distances B and C, and that the distance C is smaller than any of the distances A and B.

Actions and Effects:

A. Basic Operation

In this image forming apparatus, toner images are transferred to the recording image in the manner mentioned above.

Specifically, as shown in FIG. 1A, first, the recording medium stored in the sheet cassette 24 is picked up by one piece at a time from the top part by the sheet feeding roller 11 and is forwarded toward the medium carrying part 102 in the downstream side. Next, the recording medium forwarded from the sheet feeding roller 11 is carried by the medium carrying part 102 to the image forming part 103 and the transfer part 104 in the downstream side while its skew is being corrected. In the image forming part 103 and the transfer part 104, the toner images are transferred onto the recording medium in the following manner.

In the image forming apparatus 1 in a start-up state, once print image data and a print instruction are input to the print controller 700 through the I/F controller 710 from external equipment such as a PC, according to the print instruction, the print controller 700 starts the print operation of the print image data in cooperation with the image forming drive controller 780, etc.

The image forming drive controller 780 drives the drive motors 781-784 to rotate the photosensitive drums 4K, 4Y, 4M, and 4C at a constant speed in a prescribed direction. Once the photosensitive drums 4K, 4Y, 4M, and 4C rotate, their powers are transmitted to the toner supply sponge rollers 9K, 9Y, 9M, and 9C, the development rollers 6K, 6Y, 6M, and 6C, and the charging rollers 5K, 5Y, 5M, and 5C, respectively, through drive transmission parts such as gear arrays. As the result, the toner supply sponge rollers 9K, 9Y, 9M, and 9C, the development rollers 6K, 6Y, 6M, 6C, and the charging rollers 5K, 5Y, 5M, and 5C rotate in their prescribed directions, respectively.

On the other hand, according an instruction from the print controller 700, the charging voltage controller 740 applies prescribed voltages to the charging rollers 5K, 5Y, 5M, and 5C to charge uniformly the surfaces of the photosensitive drums 4K, 4Y, 4M, and 4C.

Next, the head drive controller 750 starts the LED heads 3K, 3Y, 3M, and 3C to radiate light corresponding to a print image based on image signals to the photosensitive drums 4K, 4Y, 4M, and 4C, thereby forming electrostatic latent images on the surfaces of the photosensitive drums 4K, 4Y, 4M, and 4C. Furthermore, toners are supplied from the toner tanks 7K, 7Y, 7M, and 7C to the toner supply sponge rollers 9K, 9Y, 9M, and 9C. The toners are carried by the toner supply sponge rollers 9K, 9Y, 9M, and 9C, and move to the vicinity of the development rollers 6K, 6Y, 6M, and 6C along with the rotation of the toner supply sponge rollers 9K, 9Y, 9M, and 9C. Then, due to differences in the electric potential between the development rollers 6K, 6Y, 6M, and 6C and the toner supply sponge rollers 9K, 9Y, 9M, and 9C, the toners are charged negatively for example, and are supplied to the development rollers 6K, 6Y, 6M, and 6C. The toners supplied to the development rollers 6K, 6Y, 6M, and 6C form toner layers regulated to have prescribed thicknesses by the development blades 8K, 8Y, 8M, and 8C.

Furthermore, the electrostatic latent images formed on the photosensitive drums 4K, 4Y, 4M, and 4C are developed with the toner layers on the development rollers 6K, 6Y, 6M, and 6C to form toner images on the photosensitive drums 4K, 4Y, 4M, and 4C. The toner images are transferred to the recording medium by electric fields between them and the transfer rollers 10K, 10Y, 10M, and 10C, which are positioned opposing the photosensitive drums 4K, 4Y, 4M, and 4C, and to which prescribed voltages are applied by the transfer voltage controller 770.

Afterwards, in the fuser device 105, heat and a pressure are applied to the toner image transferred to the recording medium to fuse the toner image on the recording medium. Afterwards, the recording medium with the toner image fused is ejected to the outside by the ejection part 106. Note that although a slight amount of toner that was not transferred to the recording medium occasionally remains on the photosensitive drum 4K, 4Y, 4M, or 4C, the remaining toner is removed by the photosensitive blade 26K, 26Y, 26M, or 26C. Therefore, the photosensitive drums 4K, 4Y, 4M, and 4C can be continuously used.

B. Operation of the Fuser Device 105

The operation of the fuser device 105 is categorized into three modes of a normal print mode (normal pressure mode), a special print mode (reduced pressure mode), and a standby mode (separation mode) according to the attitudes (rotational positions) of the first cams L1 and R1 and the second cams L2 and R2.

Figure 14A:
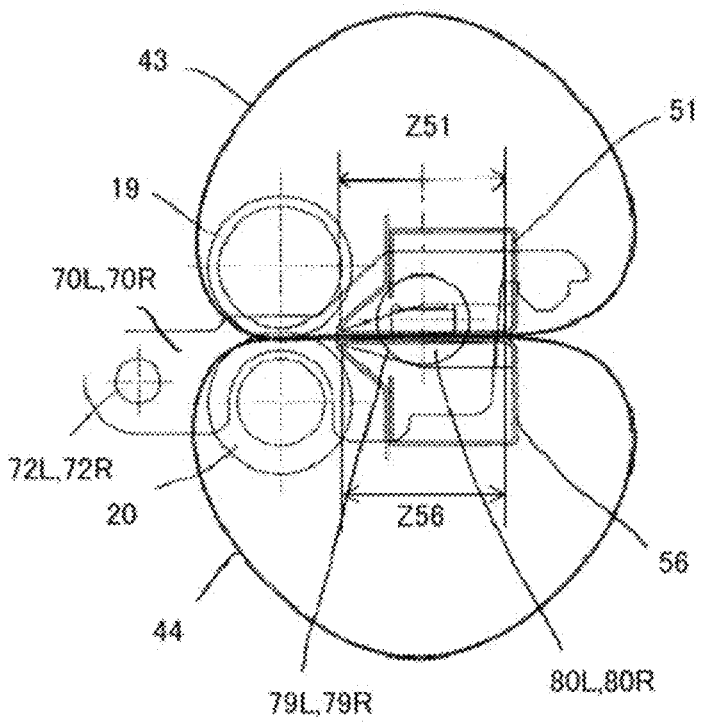
FIG. 14A is a schematic view showing the positional relationship between the fuser unit and a pressure application unit corresponding to the normal pressure mode in the fuser device shown in FIG. 4.
Figure 14B:
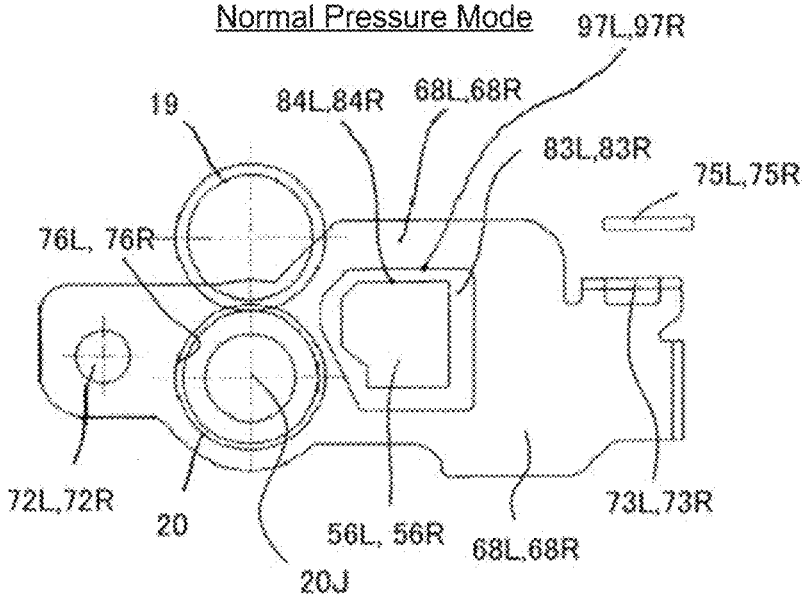
FIG. 14B is another schematic view showing the positional relationship between the fuser unit and the pressure application unit corresponding to the normal pressure mode in the fuser device shown in FIG. 4.

Normal Print Mode:

Referring to FIGS. 14A and 14B, the normal print mode is explained. The print controller 700 judges the kind of the recording medium, and if the recording medium is a normal medium (not a special medium such as an envelope, thin paper, or weighing paper that can easily generate wrinkles), the following operation is performed. Specifically, by the fusing controller 790, the cam motor 794 is driven to rotate the first cam gears LG1 and RG1 and the second cam gears LG2 and RG2 in an interlocking manner, and hold the first cams L1 and R1 and the second cams L2 and R2 in attitudes shown in FIGS. 12A and 12B. That is, in the normal print mode, rotations of the first cam gears LG1 and RG1 and the second cam gears LG2 and RG2 are stopped in positions where the contact protrusion plates 93L, 93R, 94L, and 94R are in contact with the cam faces AL1 and AR1 of the first cams L1 and R1 and the cam faces AL2 and AR2 of the second cams L2 and R2. Therefore, the contact protrusion plates 93L, 93R, 94L, and 94R are held in positions at the distance A from the shaft 87J or 89J, thereby the intermediate chassis 65 is held in the highest position among the three modes. Furthermore, because the holding arms 68L and 68R rotate upward centering on the rotation shaft parts 72L and 72R by the bias forces of the first bias members 74L and 74R, the pressure application roller 20 is biased to the fuser roller 19 through the pressure application belt 44 and the fuser belt 43. At this time, the extending direction of the holding arms 68L and 68R nearly coincides with the Z-axis direction, and the upper ends of the stoppers 73L and 74R of the holding arms 68L and 68R are separated from the lower ends of the lock parts 75L and 75R of the intermediate chassis 65. On the other hand, because the holding arms 70L and 70R rotate upward centering on the rotation shaft parts 72L and 72R by the bias forces of the second bias members 78L and 78R, the pressing face 56T of the pressure application pad 56 is biased to the pressing face 51T of the fuser pad 51 through the pressure application belt 44 and the fuser belt 43. As the result, the nip part N is formed at the boundary between the pressure application belt 44 and the fuser belt 43 (FIG. 5C).

At this time, spaces are generated between the edges 97L and 97R of the penetration holes 83L and 83R formed on the holding arms 68L and 68R and the contact faces 84L and 84R. Therefore, the pressure application pad 56 can rotate centering on the rotation shaft 56J so that the pressing face 56T comes to have an approximately parallel attitude to the pressing face 51T following the attitude of the fuser pad 51. As the result, a state of so-called partial contact where only part of the nip part N in the Z-axis direction is in press-contact is avoided, thereby a stable nip pressure having high uniformity over the whole nip part N can be obtained. Especially, if it is arranged so that the center position of the pressing face 51T of the fuser pad 51 approximately coincides with the center position of the pressing face 56T of the pressure application pad 56 in the Z-axis direction, variation of the nip pressure in the nip part N can be further reduced.

Figure 15A:
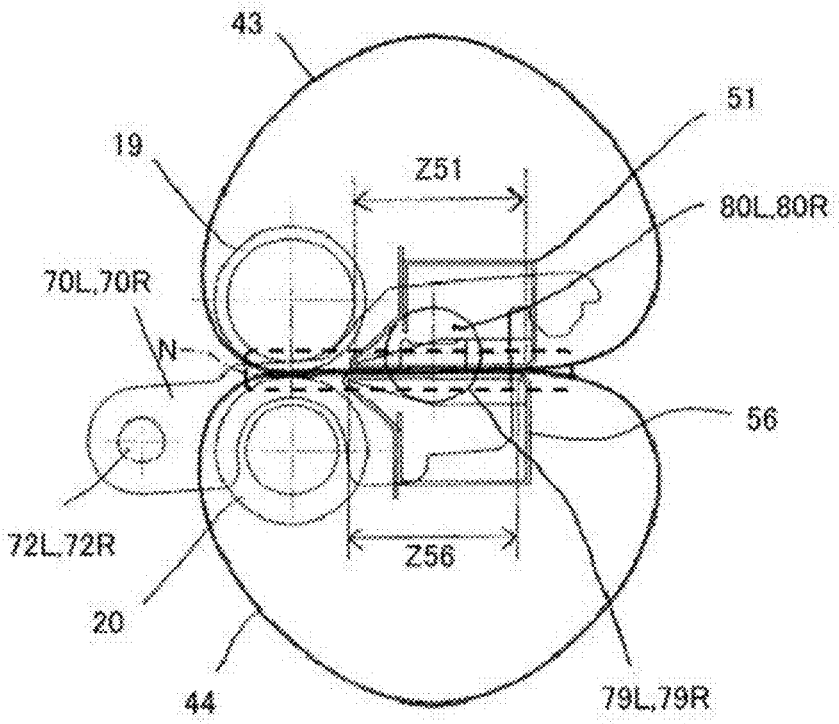
FIG. 15A is a schematic view showing the positional relationship between the fuser unit and the pressure application unit corresponding to the reduced pressure mode in the fuser device shown in FIG. 4.
Figure 15B:
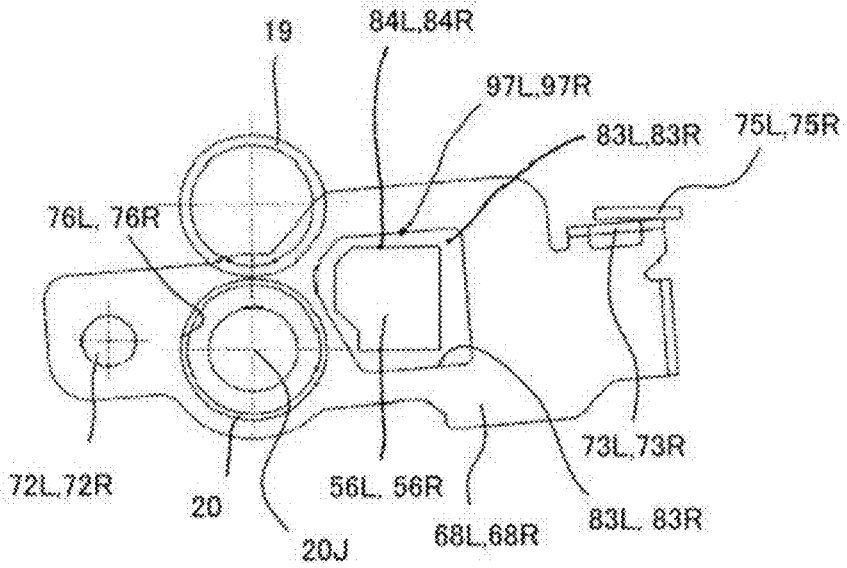
FIG. 15B is another schematic view showing the positional relationship between the fuser unit and the pressure application unit corresponding to the reduced pressure mode in the fuser device shown in FIG. 4.

Special Print Mode:

Next, referring to FIGS. 15A and 15B, the special print mode is explained. The special print mode is a mode to perform the fusing operation when the recording medium is a special medium such as an envelope, thin paper, or weighing paper that can easily develop wrinkles. In this case, the fusing operation is performed with a lower nip pressure than in the normal print mode. If the print controller 700 judges that the recording medium is a special medium, the following operation is performed. Specifically, the cam motor 794 is driven by the fusing controller 790 to rotate the first cam gears LG1 and RG1 and the second cam gears LG2 and RG2 in an interlocking manner and hold the first cams L1 and R1 and the second cams L2 and R2 in attitudes shown in FIG. 13A. That is, in the special print mode, rotations of the first cam gears LG1 and RG1 and the second cam gears LG2 and RG2 are stopped in positions where the contact protrusion plates 93L, 93R, 94L, and 94R are in contact with the cam faces BL1 and BR1 of the first cams L1 and R1 and the cam faces BL2 and BR2 of the second cams L2 and R2, respectively. Therefore, the contact protrusion plates 93L, 93R, 94L, and 94R are held in positions at the distance B from the shaft 87J or 89J, thereby the intermediate chassis 65 is held in a slightly lower position in the Y-axis direction than in the normal print mode. Therefore, as shown in FIG. 15B, the holding arms 68L and 68R rotate upward by the bias forces of the first bias members 74L and 74R by a larger rotation angle. At this time, because the holding arms 68L and 68R come into a somewhat inclined state than in the normal print mode, the upper ends of the stoppers 73L and 73R of the holding arms 68L and 68R come into contact with the lower ends of the lock parts 75L and 75R of the intermediate chassis 65. Therefore, the pressure application roller 20 supported by the holding arms 68L and 68R is biased to the fuser roller 19 through the pressure application belt 44 and the fuser belt 43 with a weaker force than in the normal print mode.

In the special print mode, in the same manner as in the normal print mode, spaces are generated between the edges 97L and 97R of the penetration holes 83L and 83R formed on the holding arms 68L and 68R and the contact faces 84L and 84R. Therefore, the pressure application pad 56 can rotate centering on the rotation shaft 56J so that the pressing face 56T comes to have an approximately parallel attitude to the pressing face 51T following the attitude of the fuser pad 51. Therefore, the holding arms 70L and 70R rotate upward centering on the rotation shaft parts 72L and 72R by the bias forces of the second bias members 78L and 78R, thereby the pressing face 56T of the pressure application pad 56 is biased to the pressing face 51T of the fuser pad 51 through the pressure application pad 44 and the fuser belt 43. Note that because the intermediate chassis 65 is held in a slightly lower position in the Y-axis direction than in the normal print mode, the holding arms 70L and 70R rotate upward by a larger rotation angle centering on the rotation shaft parts 72L and 72R by the bias forces of the second bias members 78L and 78R. Therefore, in the special print mode, the bias forces of the second bias members 78L and 78R are weaker than in the normal print mode. That is, the pressure application pad 56 is biased to the fuser pad 51 with a weaker force than in the normal print mode.

Based on the above results, in the special print mode, although the nip part N is formed at the boundary between the pressure application belt 44 and the fuser belt 43, in the nip part N the pressure application belt 44 and the fuser belt 43 are pressed against each other with a weaker force than in the normal print mode. Also in the special print mode, the pressure application pad 56 can rotate centering on the rotation shaft 56J so that the pressing face 56T comes into an approximately parallel attitude to the pressing face 51T following the attitude of the fuser pad 51. As the result, a state of so-called partial contact where only part of the nip part N in the Z-axis direction is in press-contact is avoided, thereby a stable nip pressure having high uniformity over the whole nip part N can be obtained. Note that because in the special print mode the holding arms 70L and 70R are in a slightly inclined state compared with that in the normal print mode, the nip part N is formed in a state where the center position of the pressing face 51T of the fuser pad 51 and the center position of the pressing face 56T of the pressure application pad 56 are slightly shifted in the Z-axis direction.

Figure 16A:
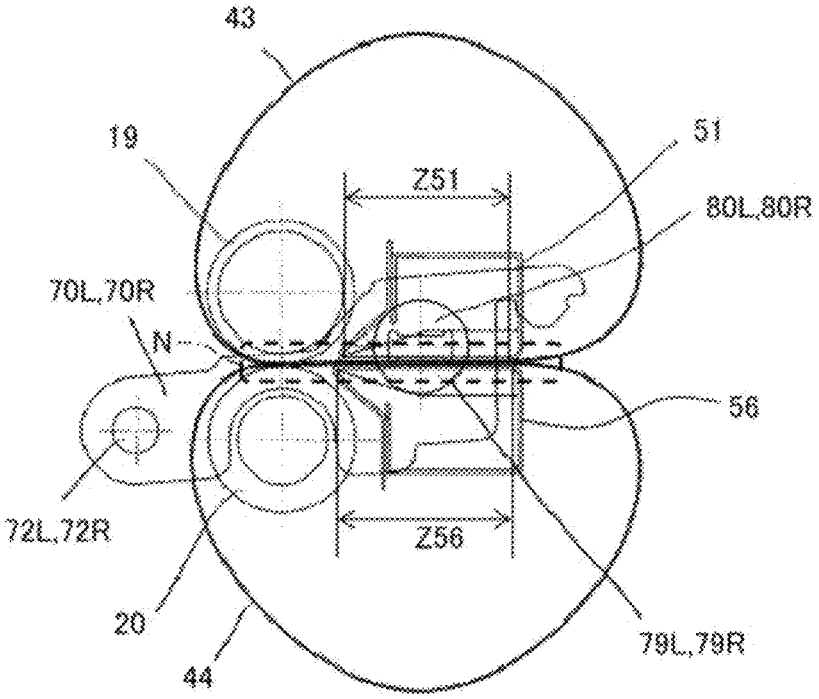
FIG. 16A is a schematic view showing the positional relationship between the fuser unit and the pressure application unit corresponding to the reduced pressure mode in the fuser device shown in FIG. 4 (when the width of the pressure application pad is large).
Figure 16B:
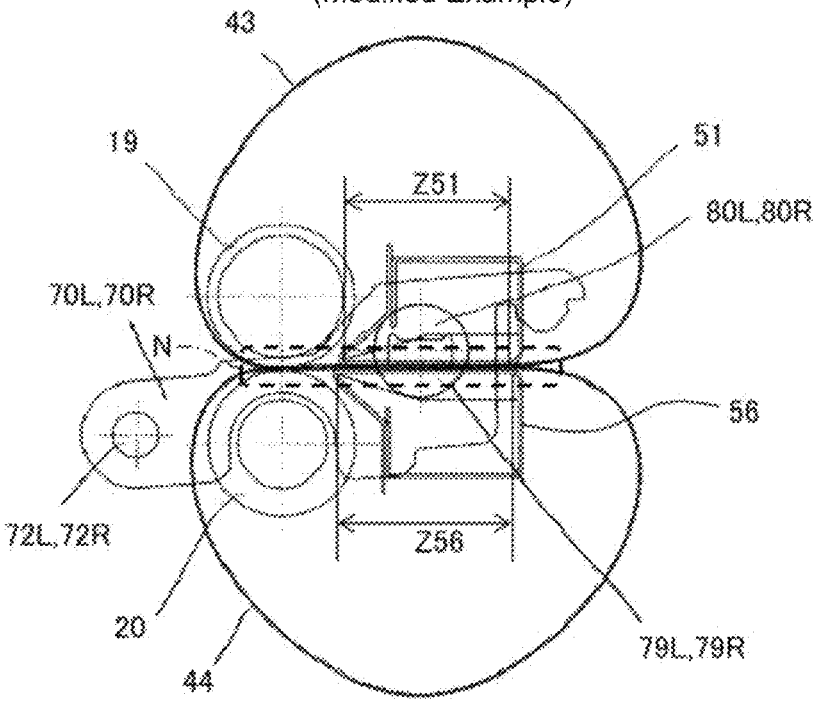
FIG. 16B is another schematic view showing the positional relationship between the fuser unit and the pressure application unit corresponding to the reduced pressure mode in the fuser device shown in FIG. 4 (when the width of the pressure application pad is large).

Then, as in a modification shown in FIGS. 16A and 16B, by setting the dimension Z56 of the pressure application pad 56 in the Z-axis direction slightly longer than the dimension Z51 of the fuser pad 51 in the Z-axis direction, a longer nip width is secured also in the special print mode. As the result, a more stable fusing operation becomes possible.

Figure 17A:
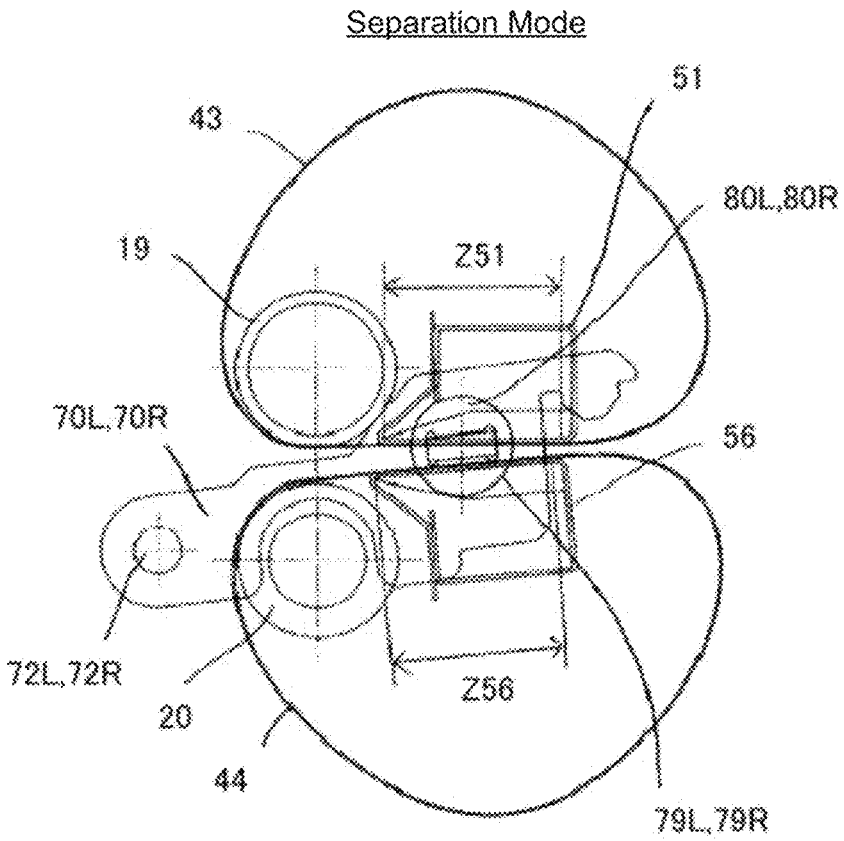
FIG. 17A is a schematic view showing the positional relationship between the fuser unit and the pressure application unit corresponding to the separation mode in the fuser device shown in FIG. 4.
Figure 17B:
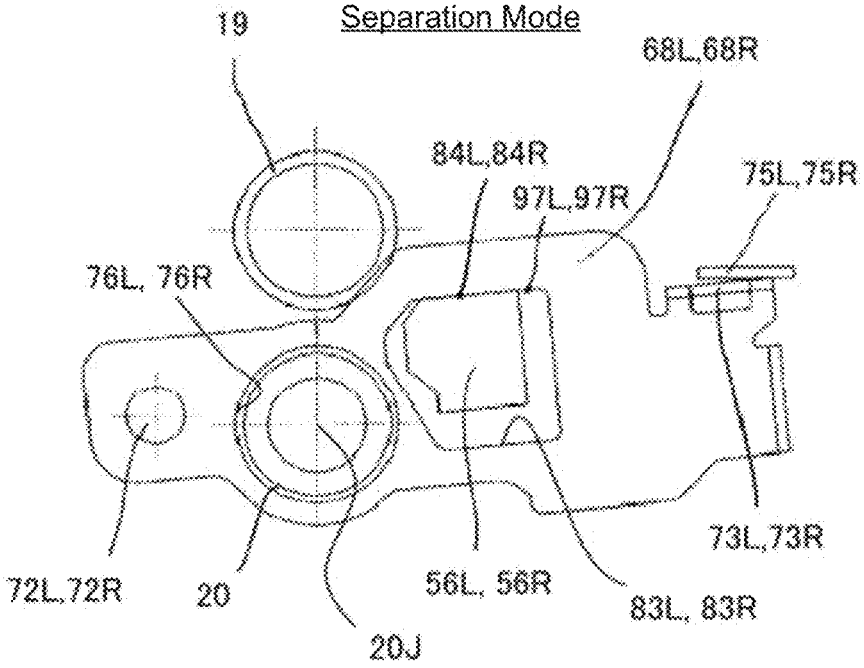
FIG. 17B is another schematic view showing the positional relationship between the fuser unit and the pressure application unit corresponding to the separation mode in the fuser device shown in FIG. 4.

Standby Mode:

Next, referring to FIGS. 17A and 17B, the standby mode (separation mode) is explained. The standby mode is a mode corresponding to a state where no fusing operation is performed to the recording medium. If the print controller 700 judges that no fusing operation is performed to the recording medium, the following operation is performed. Specifically, the cam motor 794 is driven by the fusing controller 790 to rotate the first cam gears LG1 and RG1 and the second cam gears LG2 and RG2 in an interlocking manner and hold the first cams L1 and R1 and the second cams L2 and R2 in attitudes shown in FIG. 12B. That is, in the standby mode, rotations of the first cam gears LG1 and RG1 and the second cam gears LG2 and RG2 are stopped in positions where the contact protrusion plates 93L, 93R, 94L, and 94R are in contact with the cam faces CL1 and CR1 of the first cams L1 and R1 and the cam faces CL2 and CR2 of the second cams L2 and R2, respectively. Therefore, the contact protrusion plates 93L, 93R, 94L, and 94R are held in positions at the distance C from the shaft 87J or 89J, thereby the intermediate chassis 65 is held in an even lower position in the Y-axis direction than in the special print mode. Therefore, in the standby mode, as shown in FIG. 17B, the upper ends of the stoppers 73L and 73R of the holding arms 68L and 68R are in contact with the lower ends of the lock parts 75L and 75R of the intermediate chassis 65, respectively, in the same manner as in the special print mode. On the other hand, in the standby mode, because the height positions of the rotation shaft parts 72L and 72R become even lower than in the special print mode, the inclination angles of the holding arms 68L and 68R become even larger. Therefore, the pressure application roller 20 held by the holding arms 68L and 68R is held in a position separated from the fuser roller 19 without biasing the fuser roller 19.

Also, the holding arms 70L and 70R rotate upward centering on the rotation shaft parts 72L and 72R by the bias forces of the second bias members 78L and 78R. Here, as mentioned above, in the standby mode, the inclination angles of the holding arms 68L and 68R are larger than in the special print mode or the normal print mode. Therefore, in the standby mode, unlike in the special print mode or the normal print mode, the contact faces 84L and 84R of the protruding parts 56L and 56R are in contact with the edges 97L and 97R of the penetration holes 83L and 83R formed on the holding arms 68L and 68R, thereby restricting the rotation angles of the holding arms 70L and 70R. As the result, no nip part N is formed at the boundary of the pressure application belt 44 and the fuser belt 43, and the pressure application belt 44 and the fuser belt 43 come into a separated state.

C. Variation of the Nip Pressure in the Fuser Device 105

Figure 18A:
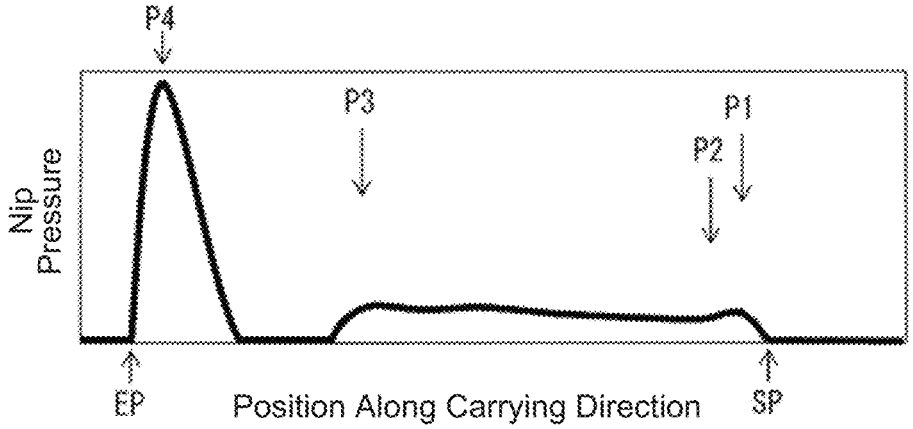
FIG. 18A is a characteristic diagram showing the distribution of a nip pressure along a medium carrying direction in the fuser device provided with the pressure application pad shown in FIG. 10.

Next, referring to FIGS. 18A-18D in addition to FIG. 10, the distribution of the nip pressure along the carrying direction of the nip part N in the fuser device 105 is explained. FIG. 18A is a characteristic diagram showing the distribution along the carrying direction of a recording medium PM of the nip pressure applied to the recording medium PM passing through the nip part N. In FIG. 18A, the horizontal axis indicates the position of the nip part N in the carrying direction (+Z direction here), and the vertical axis indicates the intensity of the nip pressure applied to the recording medium PM. In FIG. 18A, a start point SP is the position where the recording medium PM starts its entrance, that is the most upstream point of the nip part N, and an end point EP indicates the position where the recording medium PM is ejected, that is the most downstream point of the nip part N. Application of the nip pressure to the recording medium PM is started at the start point SP and ends at the end point EP. Therefore, the length from the start point SP to the end point EP is the length of the nip part N in the carrying direction.

As shown in FIG. 18A, the fuser device 105 shows a slightly higher nip pressure immediately after the start point SP (in a position P1), and afterwards a lower nip pressure in a position P2. Afterwards, the nip pressure monotonously increases gradually toward the downstream side and tentatively becomes substantially 0 after passing a position P3. The position P3 corresponds to the most downstream position of the part where the fuser pad 51 and the pressure application pad 56 oppose each other. When the recording medium PM progresses further downstream, the nip pressure reaches the maximum value in a position P4 where the fuser roller 19 and the pressure application roller 20 oppose each other, and afterwards the nip pressure becomes substantially 0 again.

Figure 18B:
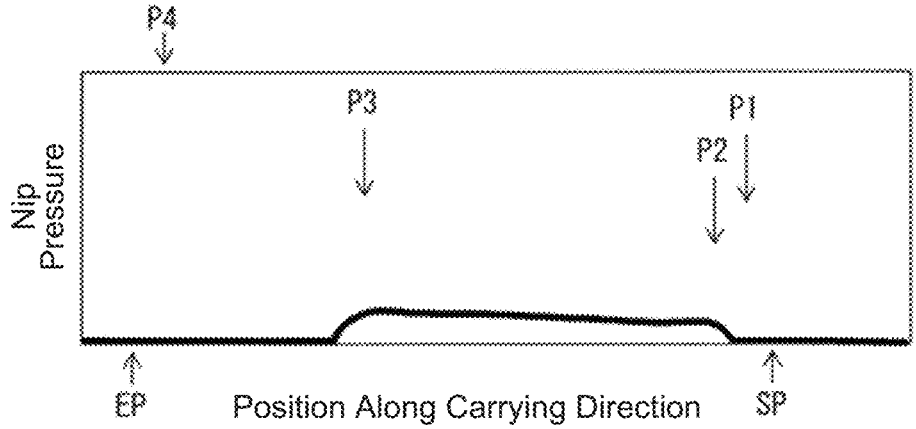
FIG. 18B is a characteristic diagram showing the distribution of a pressure component of the nip pressure shown in FIG. 18A.
Figure 18C:
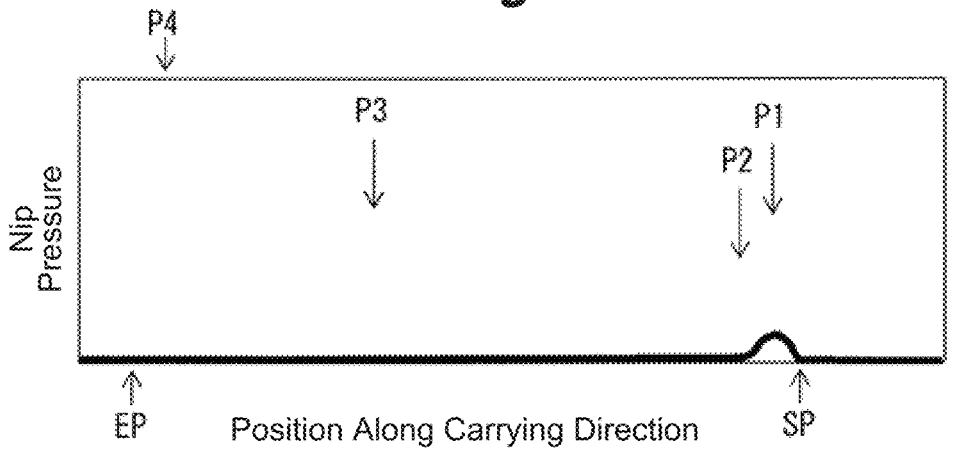
FIG. 18C is a characteristic diagram showing the distribution of another pressure component of the nip pressure shown in FIG. 18A.
Figure 18D:
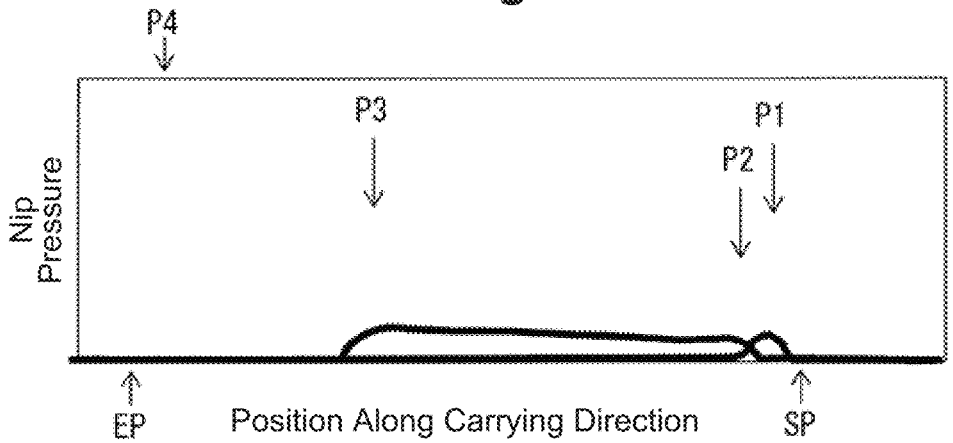
FIG. 18D is a characteristic diagram showing the distribution of the synthesis of the pressure component shown in FIG. 18B and the other pressure component shown in FIG. 18C.

Here, the nip pressure shown in FIG. 18A is believed to be the synthesis of a pressure A caused by the fuser roller 19 and the pressure application roller 20, a pressure B caused by the fuser pad 51 and the pressure application pad 56, and a pressure C caused by the fuser belt 43 and the pressure application belt 44. Then, by decomposing the nip pressure shown in FIG. 18A, the distribution of only the pressure B is shown in FIG. 18B, the distribution of only the pressure C is shown in FIG. 18C. Furthermore, the distribution of the synthetic pressure of the pressure B and the pressure C is shown in FIG. 18D. Note that a peak of the nip pressure appearing in the position P4 in FIG. 18A is clearly due to the above-mentioned pressure A.

Based on comparison of FIGS. 18A-18D, it is believed that a small peak of the nip pressure in the position P1 in FIG. 18A is due mainly to the pressure C, that is, the weight of the fuser belt 43 and the pressure application belt 44 and rigidity of the materials composing them, etc. Furthermore, it is believed that variation of the nip pressure from the position P2 to the position P3 is mainly due to the pressure B, that is, caused by bias forces by the fuser pad 51 and the pressure application pad 56. Also, the position P2 is a position where the distribution of the pressure B stands up, which corresponds to the position of the step D1 installed on the pressing face 56T of the pressure application pad 56.

Figure 19:
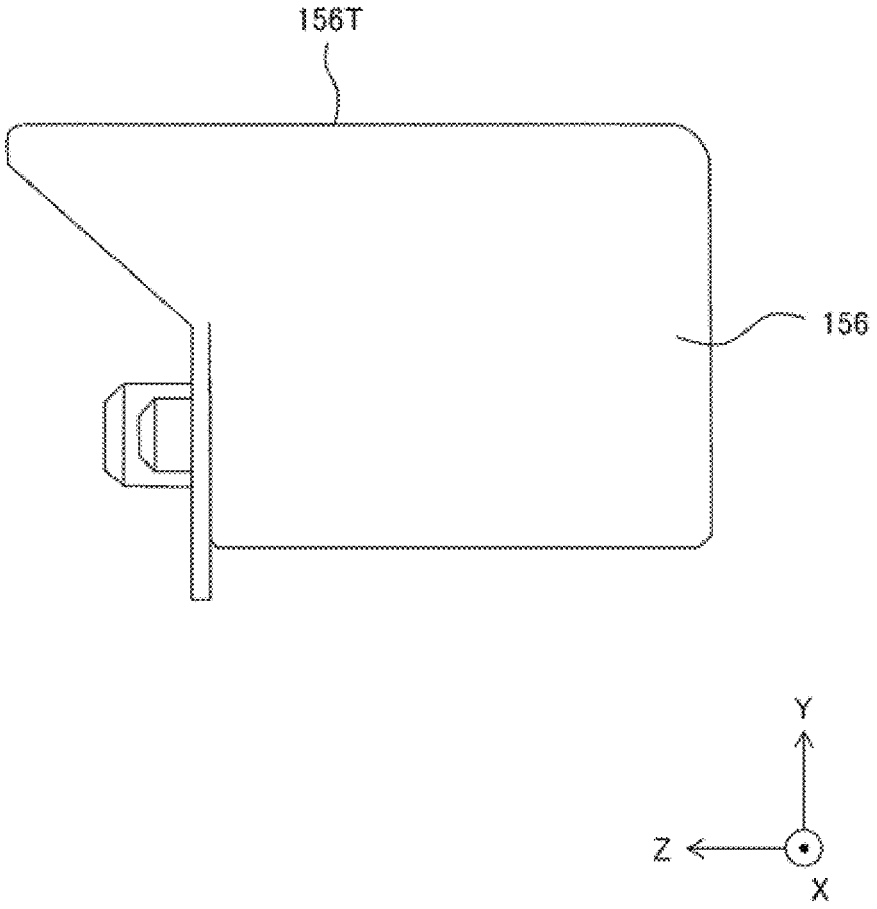
FIG. 19 is an enlarged cross-sectional view of the pressure application pad as a reference example.
Figure 20A:
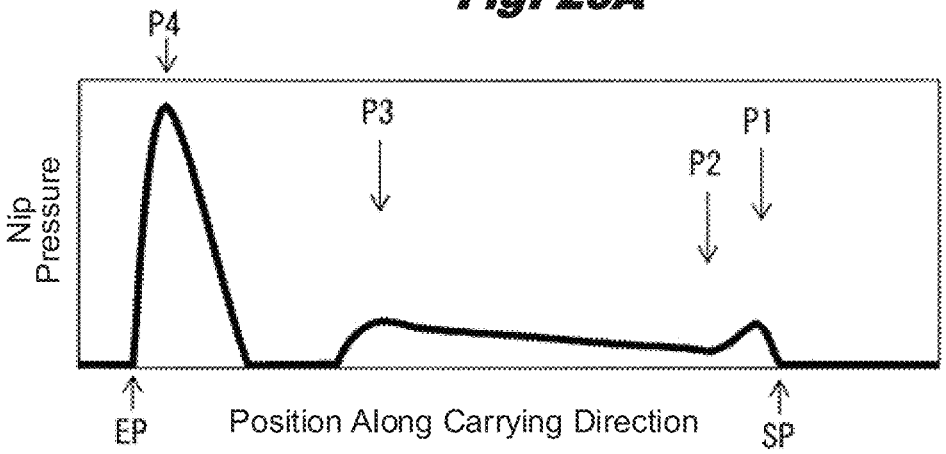
FIG. 20A is a characteristic diagram showing the distribution of the nip pressure along the medium carrying direction in the fuser device provided with the pressure application pad shown in FIG. 19.
Figure 20B:
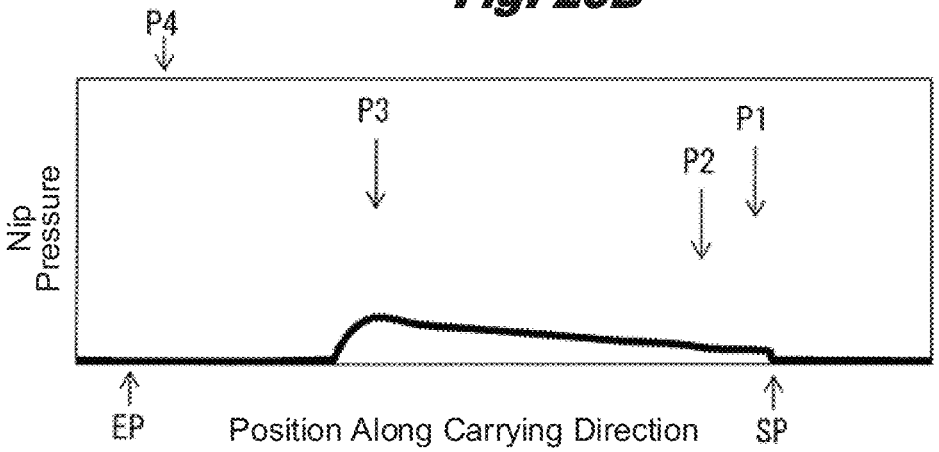
FIG. 20B is a characteristic diagram showing the distribution of a pressure component of the nip pressure shown in FIG. 20A.
Figure 20C:
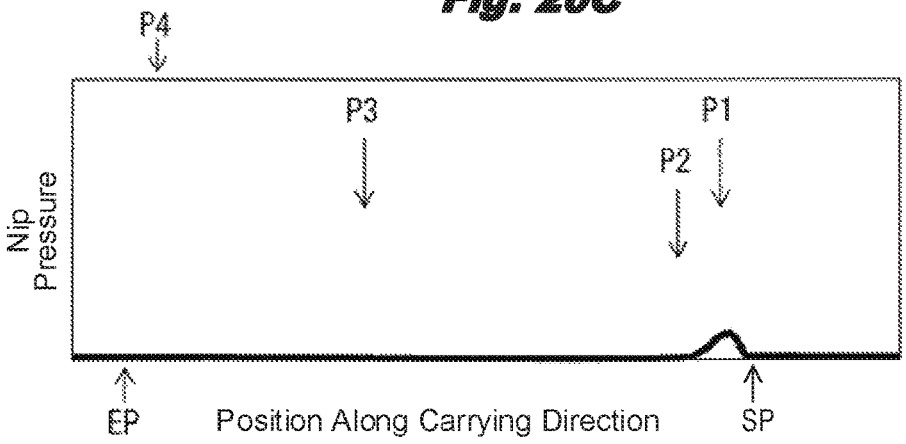
FIG. 20C is a characteristic diagram showing the distribution of another pressure component of the nip pressure shown in FIG. 20A.
Figure 20D:
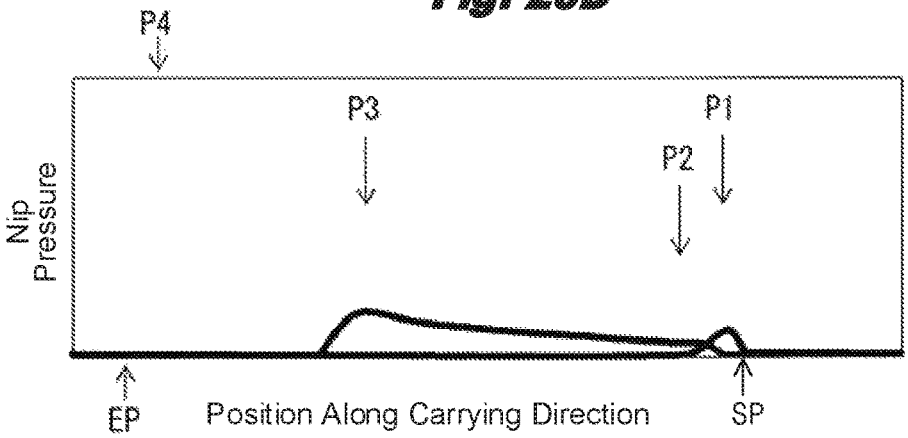
FIG. 20D is a characteristic diagram showing the distribution of the synthesis of a pressure component shown in FIG. 20B and another pressure component shown in FIG. 20C.

As opposed to this, if a pressure application pad 156 as a reference example shown in FIG. 19 is used instead of the pressure application pad 56 of this embodiment for example, the nip pressure in the fuser device 105 shows a distribution shown in FIGS. 20A-20D for example. FIG. 20A corresponds to FIG. 18A, and is a characteristic diagram showing the distribution along the carrying direction of the recording medium PM of the nip pressure applied to the recording medium PM passing through the nip part N if the pressure application pad 156 in FIG. 19 is used. Unlike the pressure application pad 56 of this embodiment shown in FIG. 10, the pressure application pad 156 in FIG. 19 has a flat pressing face 156T from the upstream side to the downstream side. FIG. 20B corresponds to FIG. 18B and shows the distribution of only the pressure B of the nip pressure shown in FIG. 20A. FIG. 20C correspond to FIG. 18C and shows the distribution of only the pressure C of the nip pressure shown in FIG. 20A. FIG. 20D corresponds to FIG. 18D and shows the distribution of the synthetic pressure of the pressure B shown in FIG. 20B and the pressure C shown in FIG. 20C.

Based on comparison between FIGS. 18A-18D and FIGS. 20A-20D, it is evident that if the pressure application pad 56 is used, compared with the case where the pressure application pad 156 is used, the nip pressure in the position P1 greatly declines, and the drop of the nip pressure in the position P2 is relaxed. Therefore, if the pressure pad 56 of this embodiment is used, a stable nip pressure having relatively small variation from the position P1 to the position P3 can be obtained. Therefore, it is expected that if the fuser device 105 of this embodiment is used, a decline in the fusing rate and image deficiencies can be avoided.

D. Effects

In this manner, in the fuser device 105 of this embodiment, the step D1 between the first part 56T1 and the second part 56T2 is installed as a pressure reducing part on the pressing face 56T of the pressure application pad 56. To be more detailed, on the pressing face 56T of the pressure application pad 56, the second part 56T2 positioned in the downstream side of the first part 56T positioned in the most upstream side protrudes more than the first part 56T1 toward the fuser belt 43. Therefore, a rise of the nip pressure in the initial state of the fusing operation (so-called a belt entry pressure) is relaxed. In the initial stage of the fusing operation, a developer image IMG transferred onto the recording medium PM is not sufficiently heated up, and there are many empty spaces among unmelted toner particles composing the developer image IMG. If a strong nip pressure is applied in such a state, the unmelted toner particles occasionally move on the surface of the recording medium PM, possibly generating an image deficiency that is so-called an image shift. In this embodiment, because the rise of the nip pressure immediately after entering the fuser device 105 is suppressed, the occurrence of such image shifts can be sufficiently avoided. Furthermore, because the rise of the nip pressure in the initial stage where the recording medium has entered the nip part N can be relaxed, a rapid drop of the nip pressure immediately afterwards can also be relaxed. For that reason also, the fuser device 105 of this embodiment is preferable for avoiding the occurrence of image shifts.

Also, in the fuser device 105 of this embodiment, by controlling the attitudes of the first cams L1 and R1 and the second cams L2 and R2, it is possible to perform status changes among the normal print mode and the special print mode that perform printing onto the recording medium, and the standby mode that does not perform printing onto the recording medium. In the fuser device 105, in the normal print mode and the special print mode, the pressure application pad 56 is supported by the holding arm 70 in such a manner that its attitude relative to the holding arm 70 can be changed. That is, the pressure application pad 56 takes a changeable attitude relative to both the pressure application roller 20 and the fuser belt 43 and the fuser pad 51. To be more detailed, the pressure application pad 56 can rotate centering on the rotation shaft 56J so that the pressing face 56T has an approximately parallel attitude to the pressing face 51T following the attitude of the fuser pad 51. As the result, a state of so-called partial contact where only part of the nip part N in the Z-axis direction is in press-contact is avoided, thereby a stable nip pressure having high uniformity over the whole nip part N can be obtained.

Therefore, according to the image forming apparatus 1 provided with the fuser device 105 of this embodiment, because the fusing process with a stable nip pressure becomes possible, a decline in the fusing rate and image deficiencies can be avoided, thereby achieving an enhancement of the image quality.

2. First Modification of the First Embodiment

Figure 21:
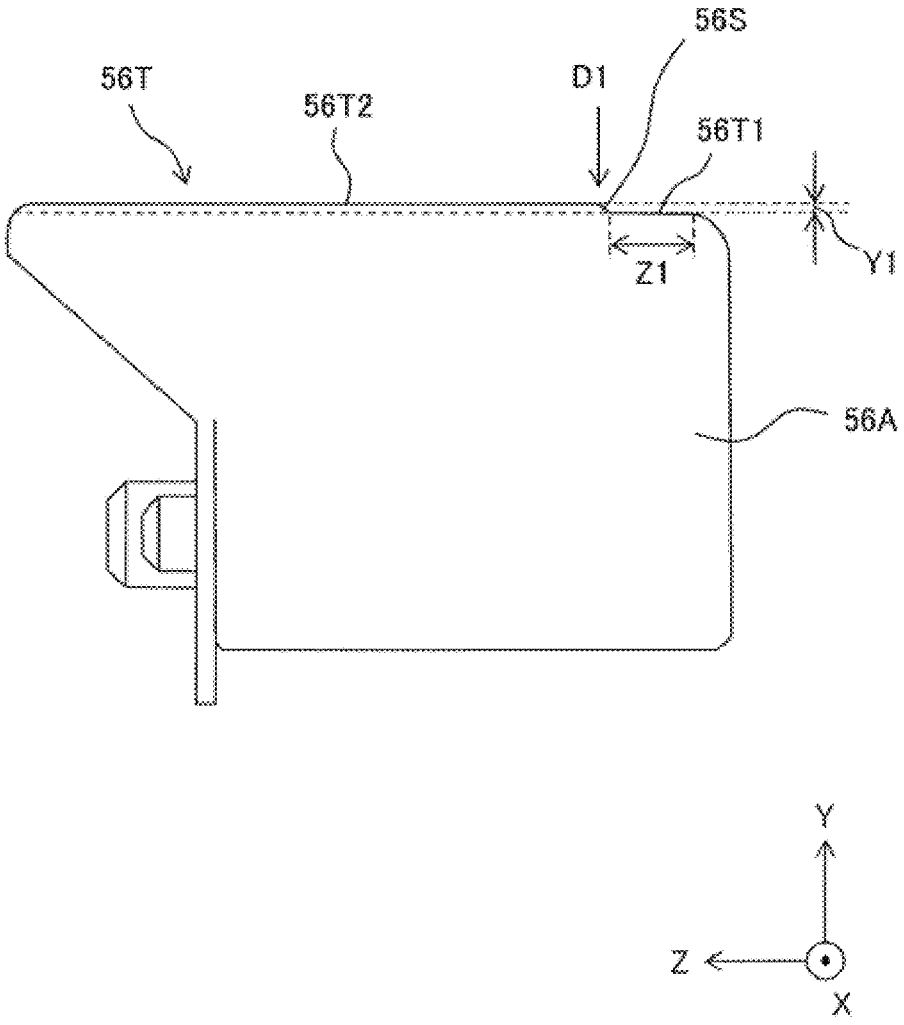
FIG. 21 is an enlarged cross-sectional view of the pressure application pad as the first modification in the first embodiment of this invention.
Figure 22A:
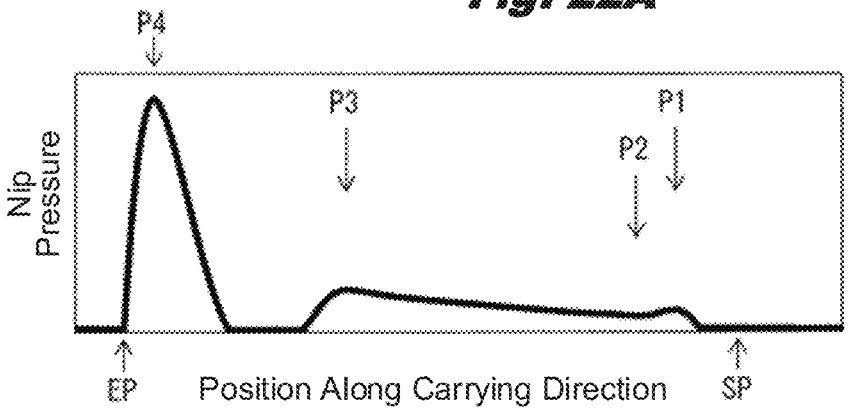
FIG. 22A is a characteristic diagram showing the distribution of the nip pressure along the medium carrying direction in the fuser device provided with the pressure application pad shown in FIG. 21.
Figure 22B:
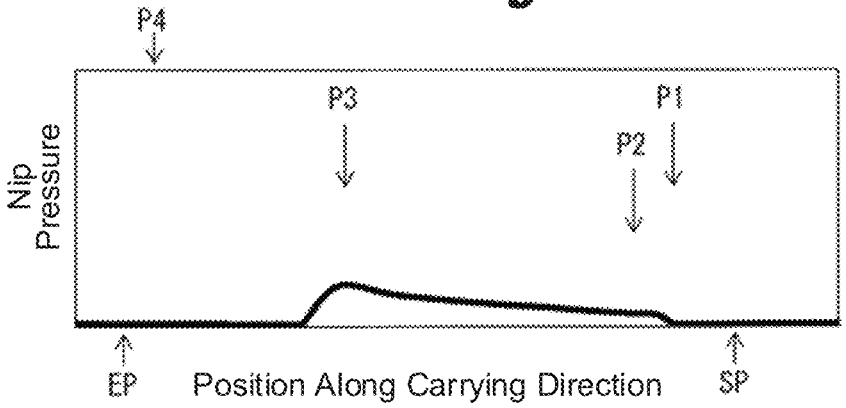
FIG. 22B is a characteristic diagram showing the distribution of a pressure component of the nip pressure shown in FIG. 22A.
Figure 22C:
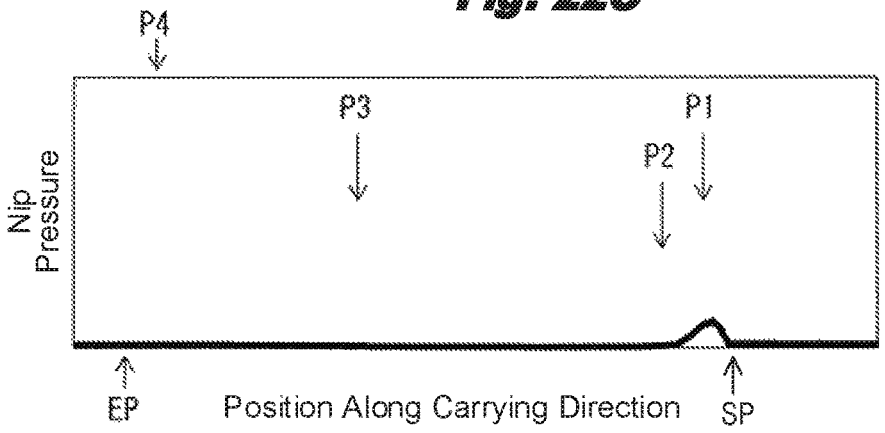
FIG. 22C is a characteristic diagram showing the distribution of another pressure component of the nip pressure shown in FIG. 22A.
Figure 22D:
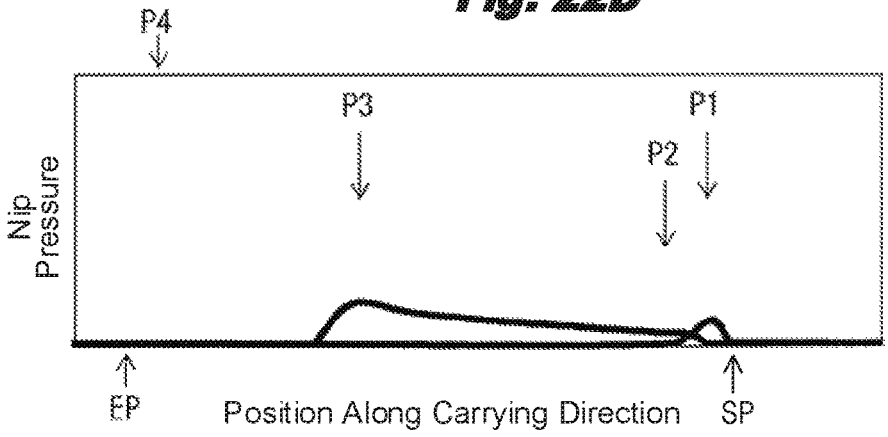
FIG. 22D is a characteristic diagram showing the distribution of the synthesis of a pressure component shown in FIG. 22B and another pressure component shown in FIG. 22C.

Next, referring to FIGS. 21 and 22A-22D, the fuser device 105 having a pressure application pad 56A as the first modification of this embodiment is explained. Shown in FIG. 21 is an enlarged cross-sectional view of the pressure application pad 56A. The pressure application pad 56A is different from the pressure application pad 56 of the above-mentioned first embodiment in that the second part 56T2 of the pressing face 56T extends along the horizontal plane.

FIGS. 22A-22D show the distribution of the nip pressure along the carrying direction of the nip part N in the fuser device 105 using the pressure application pad 56A, and correspond to FIGS. 18A-18D where the pressure application pad 56 of this embodiment mentioned above is used. In this modification also, in the same manner as when the pressure application pad 56 is used (FIGS. 10 and 18A-18D), a stable nip pressure having relatively small variation from the position P1 to the position P3 can be obtained. Therefore, it is expected that if the fuser device 105 provided with the pressure application pad 56A of this modification is used, a decline in the fusing rate and image deficiencies can be avoided. Especially, if the pressure application pad 56A of this modification is used, the nip pressure in the position P3 can be more enhanced than when the pressure application pad 56 is used. The reason is that the second part 56T2 extends along the horizontal plane.

3. Second Modification of the First Embodiment

Figure 23:
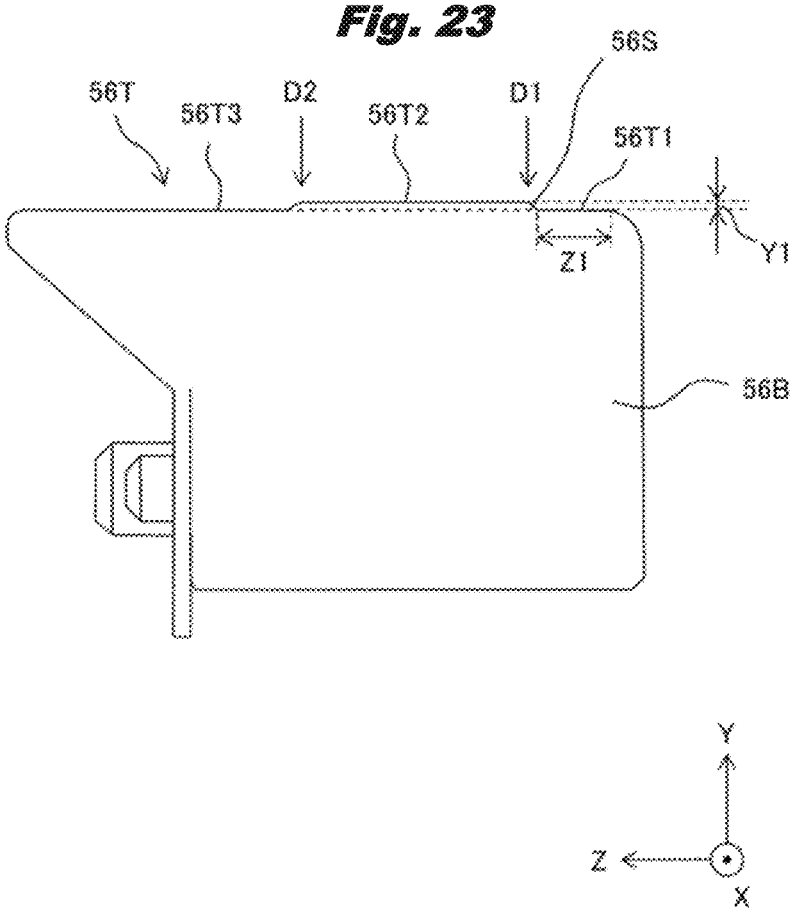
FIG. 23 is an enlarged cross-sectional view of the pressure application pad as the second modification in the first embodiment of this invention.
Figure 24A:
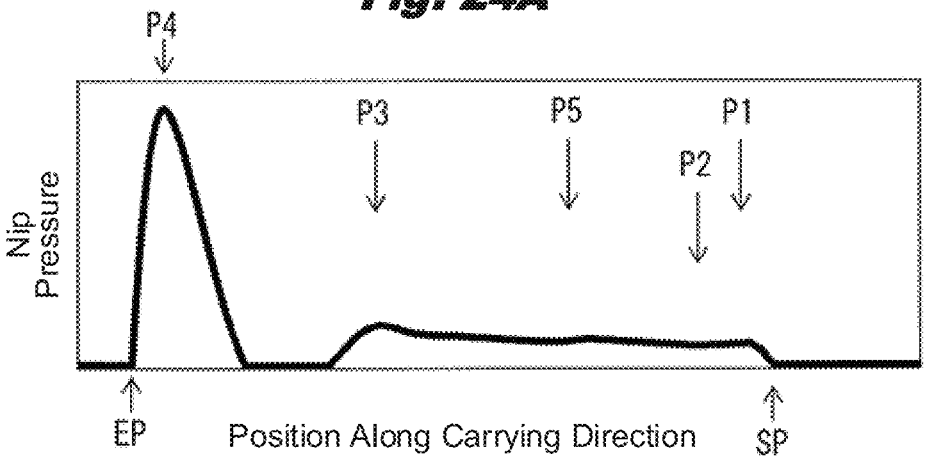
FIG. 24A is a characteristic diagram showing the distribution of the nip pressure along the medium carrying direction in the fuser device provided with the pressure application pad shown in FIG. 23.
Figure 24B:
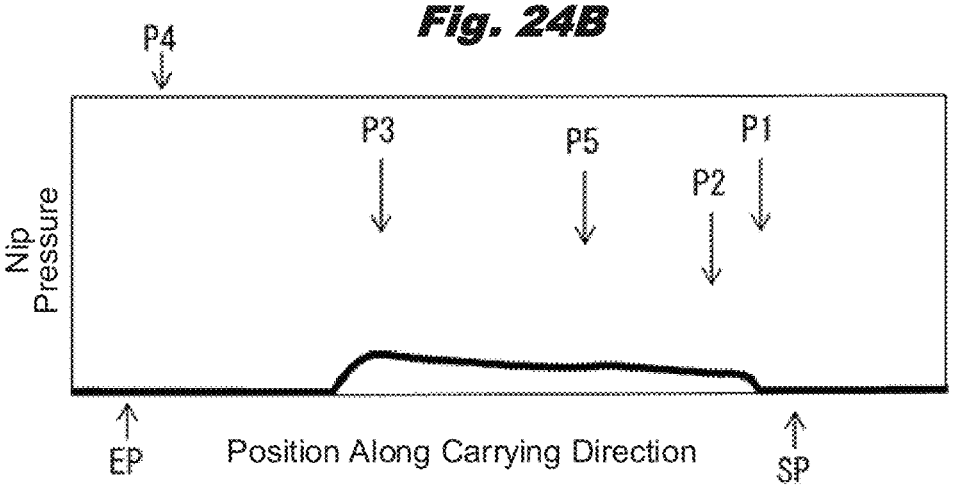
FIG. 24B is a characteristic diagram showing the distribution of a pressure component of the nip pressure shown in FIG. 23A.
Figure 24C:
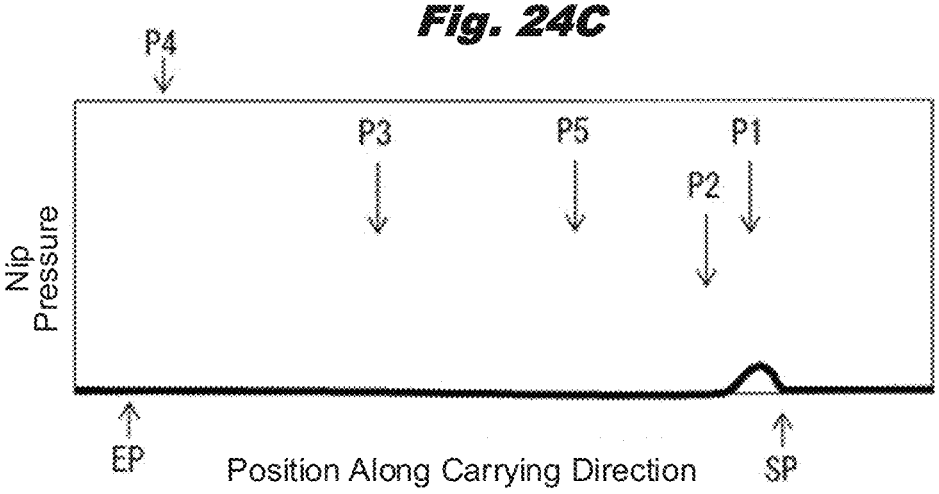
FIG. 24C is a characteristic diagram showing the distribution of another pressure component of the nip pressure shown in FIG. 23A.
Figure 24D:
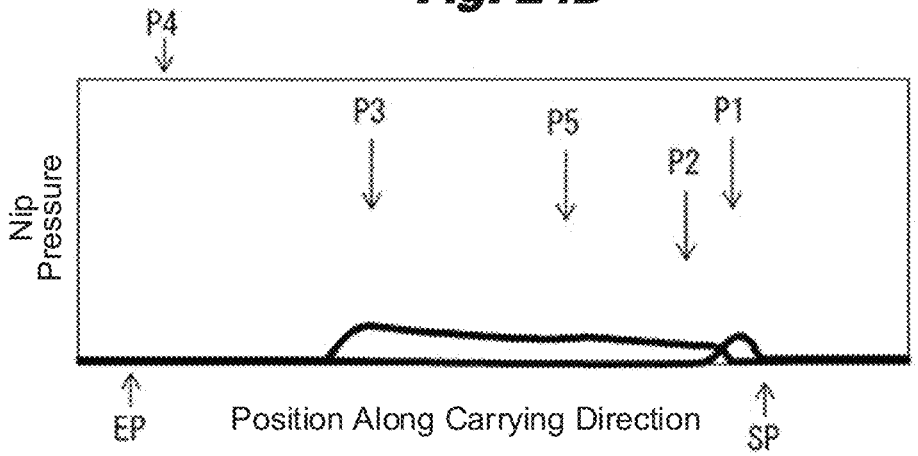
FIG. 24D is a characteristic diagram showing the distribution of the synthesis of the pressure component shown in FIG. 23B and the other pressure component shown in FIG. 23C.

Next, referring to FIGS. 23 and 24A-24D, the fuser device 105 having a pressure application pad 56B of the second modification of this embodiment is explained. Shown in FIG. 23 is an enlarged cross-sectional view of the pressure application pad 56B. The pressure application pad 56B is different from the pressure application pad 56A in the first modification of the above-mentioned first embodiment in that a third part 56T3 is installed in the downstream side of the second part 56T2 on the pressing face 56T. The third part 56T3 is in a position that is farther from the fuser belt 43 than the second part 56T2 is. That is, the third part 56T3 extends along the horizontal plane in a lower position than the second part 56T2 in the Y-axis direction. Therefore, a step D2 between the second part 56T2 and the third part 56T3 occurs.

FIGS. 24A-24D show the distributions of the nip pressure along the carrying direction of the nip part N in the fuser device 105 using the pressure application pad 56B, and correspond to FIGS. 18A-18D for the case where the pressure application pad 56 of this embodiment mentioned above is used. In this modification also, in the same manner as when the pressure pad 56 is used (FIGS. 10 and 18A-18D), a stable nip pressure having relatively small variation from the positon P1 to the position P3 can be obtained. Therefore, it is expected that if the fuser device 105 provided with the pressure application pad 56B of this modification is used also, a decline in the fusing rate and image deficiencies can be avoided. Especially, when the pressure application pad 56B of this modification is used, the nip pressure in the position P3 can be suppressed at a lower level than when the pressure pad 56 is used. The reason is that the step D2 between the second part 56T2 and the third part 56T3 is installed on the pressing face 56T, thereby the pressure B slightly drops in a position P5 in the middle of reaching the positon P3 from the positon P2 where the pressure B caused by the fuser pad 51 and the pressure application pad 56 is dominant.

4. Second Embodiment

Configuration of the Fuser Device 205:

Next, referring to FIGS. 25A-29, the detailed configuration of a fuser device 205 of the second embodiment of this invention is explained. Instead of the fuser device 105 of the first embodiment mentioned above, the fuser device 205 can be applied to the image forming apparatus 1 shown in FIG. 1A.

Figure 25A:
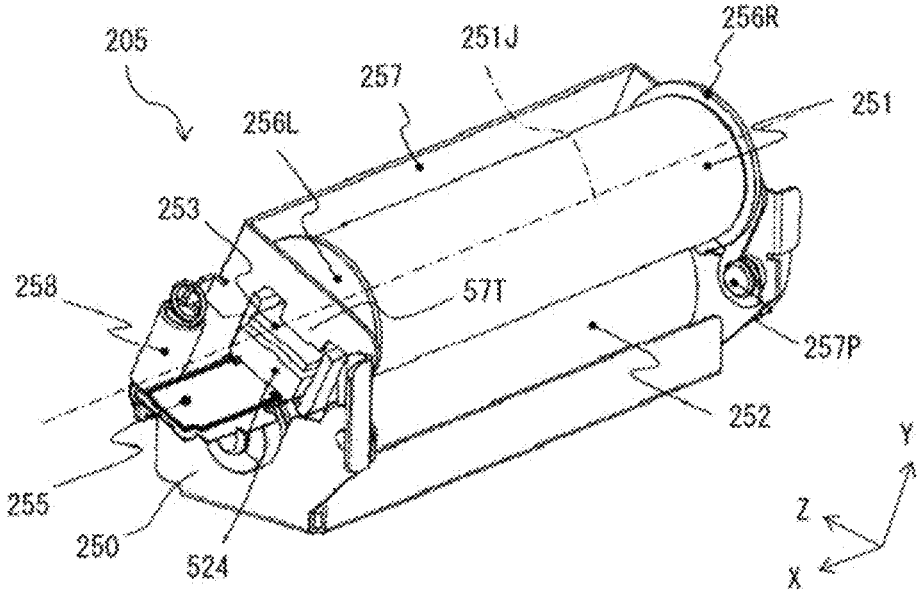
FIG. 25A is an enlarged perspective view showing the external appearance of a fuser device of the second embodiment of this invention.
Figure 25B:
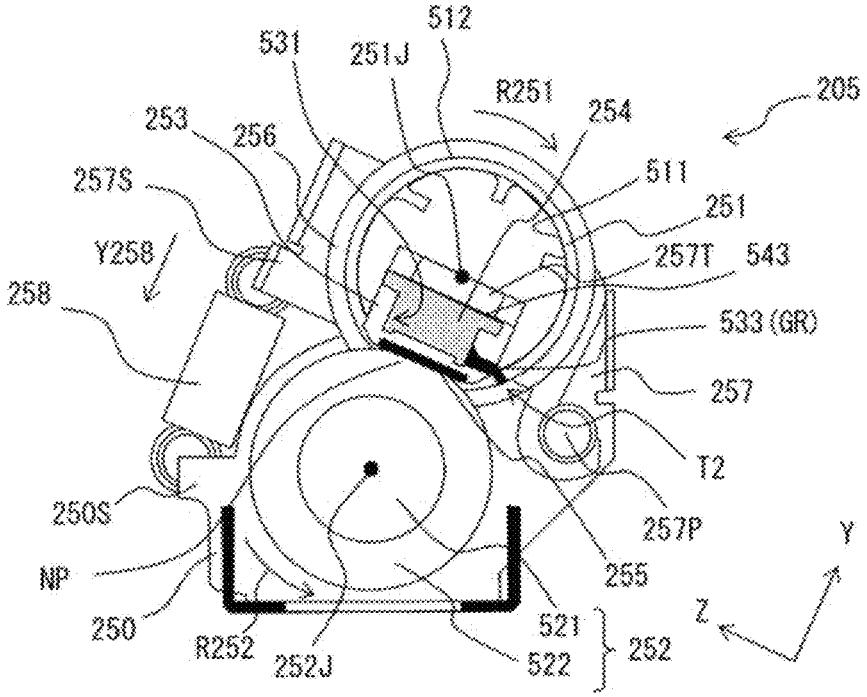
FIG. 25B is a cross-sectional view showing the cross-sectional structure of the fuser device shown in FIG. 25A.
Figure 26A:
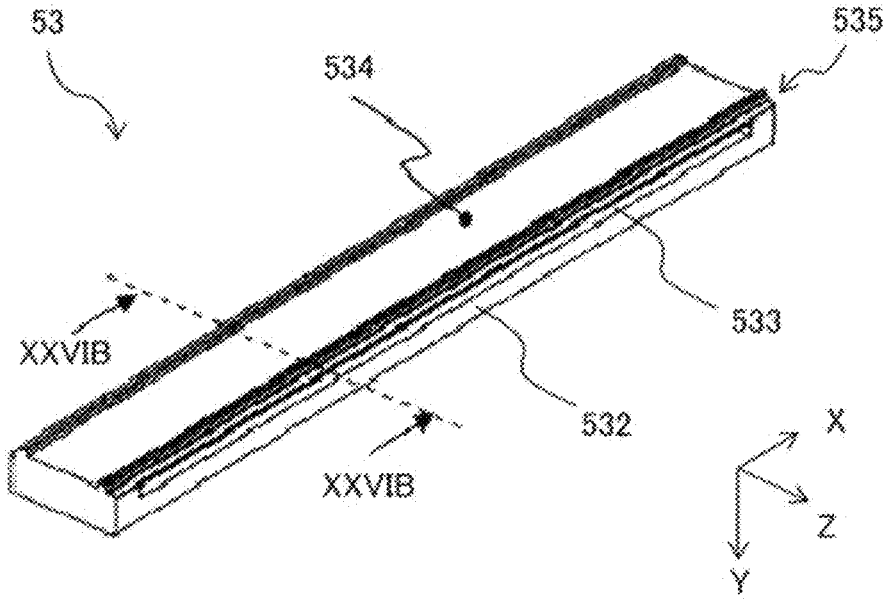
FIG. 26A is an enlarged perspective view of a holding member of the fuser device shown in FIG. 25A.
Figure 26B:
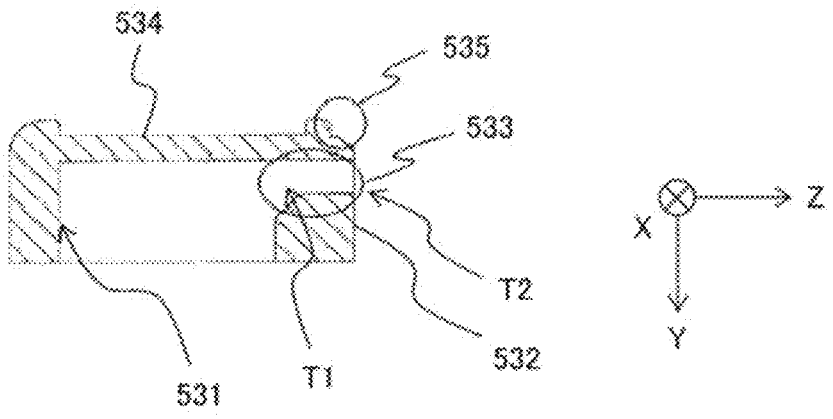
FIG. 26B is a cross-sectional view of the holding member of the fuser device shown in FIG. 26A.
Figure 27:
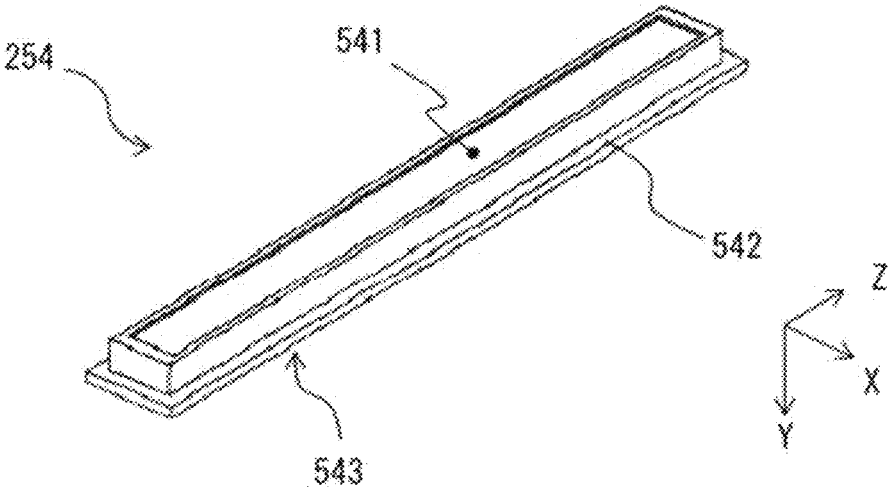
FIG. 27 is an enlarged perspective view of a pressure application member of the fuser device shown in FIG. 25A.
Figure 28:
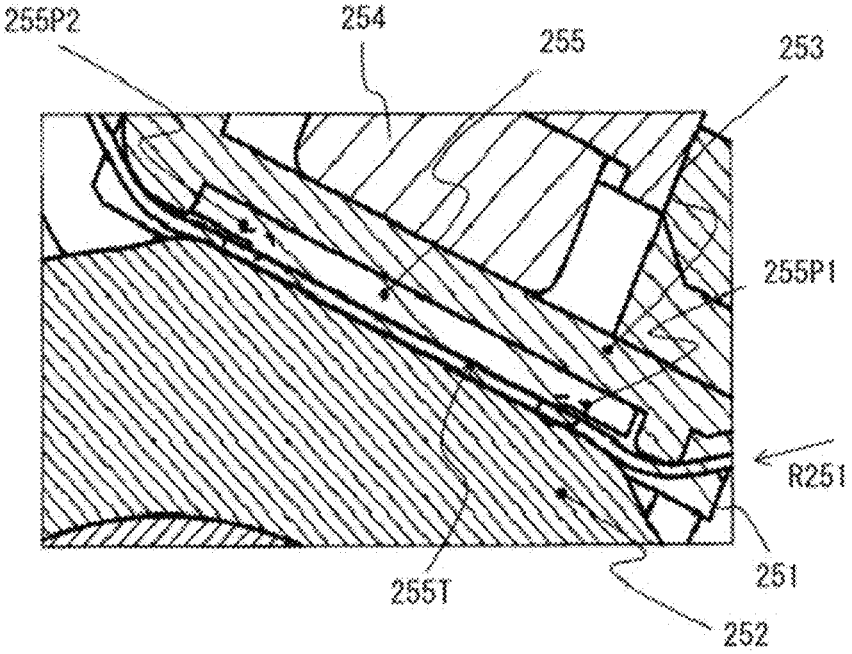
FIG. 28 is an enlarged cross-sectional view of the vicinity of a nip part of the fuser device shown in FIG. 25A.
Figure 29:
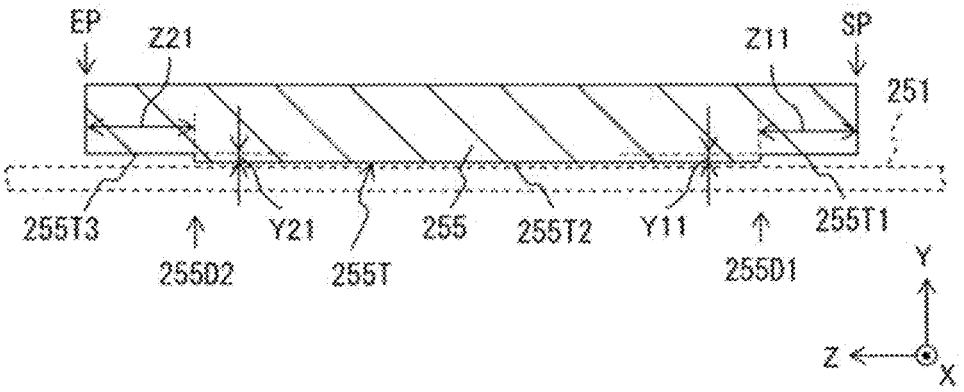
FIG. 29 is an enlarged cross-sectional view of a heater shown in FIG. 28.

FIG. 25A is a perspective view showing the external appearance of the fuser device 205 seen from the upstream side in the carrying direction of the recording medium, and FIG. 25B is a cross-sectional view of the fuser device 205. FIG. 26A is an enlarged perspective view showing a holding member 253 (mentioned below) that is a component of the fuser device 205. FIG. 26B is a cross-sectional view of the holding member 253 shown in FIG. 26A along a line XXVIB-XXVIB seen in the direction of arrows. FIG. 27 is an enlarged perspective view showing a pressure application member 254 that is another component of the fuser device 205. FIG. 28 is an enlarged cross-sectional view of the vicinity of a nip part NP of the fuser device 205. FIG. 29 is an enlarged cross-sectional view of a heater 255 in the fuser device 205.

The fuser device 205 has, for example, a base part 250, a fuser belt 251, a pressure application roller 252, a holding member 253, a pressure application member 254, a heater 255, flanges 256 (256L and 256R), a lever member 257, and a bias member 258. Between the holding member 253 and the pressure application member 254, a lubricant GR (see FIG. 25B) is held. The lubricant GR is, for example, gelatinous grease, and functions so as to reduce friction between members by forming a thin oil film on the surfaces of the members it adheres to, thereby improving slidability.

The fuser belt 251 is an endless elastic belt of a tube shape having an inner circumferential face 511 and an outer circumferential face 512, and for example, is an endless elastic belt made of a resin material such as polyimide resin, or made by forming silicone rubber etc. on a metallic base material such as stainless steel. The fuser belt 251 is stretched by the pair of flanges 256L and 256R installed at both ends in the width direction, the heater 255, etc., and is installed in a cyclically rotatable manner in the direction of an arrow R251 in FIG. 25B (rightward rotation in FIG. 25B) around a shaft 251J (FIGS. 25A and 25B). To be more detailed, the fuser belt 251 is supported in a freely rotatable manner by the pair of flanges 256L and 256R fixed to the lever member 257 at both ends of its width direction. The outer circumferential face 512 of the fuser belt 251 is biased by the bias member 258 so as to be in contact with the pressure application roller 252 opposing it in the Y-axis direction, forming the nip part NP spreading in the XZ plane (FIG. 25B). The fuser belt 251 rotates in the direction of the arrow R251 following the rotation of the pressure application roller 252. In this example, in the vicinity of the nip part NP, the fuser belt 251 moves in the +Z direction. The holding member 253, the pressure application member 254, the heater 255, etc. are all disposed in a space surrounded by the fuser belt 251. Note that the fuser belt 251 is a specific example corresponding to the "first rotation member" of this invention.

The pressure application roller 252 is a columnar or cylindrical object extending in the X-axis direction, and is installed rotatable in the direction of an arrow R252 (FIG. 25B) around a shaft 252J extending along the shaft 251J. The pressure application roller 252 has, for example, a shaft 521 made of a rigid material such as a metallic pipe extending in the X-axis direction, and an elastic layer 522 installed surrounding the shaft 521. The shaft 521 is supported in a freely rotatably manner by the base part 250 in the vicinities of its both ends. The base part 250 is, for example, fixed to a chassis 100. As shown in FIG. 25B, the pressure application roller 252 is in contact with the outer circumferential face 512 of the fuser belt 251 to form the nip part NP. In this example, in the vicinity of the nip part NP, the pressure application roller 252 moves in the +Z direction. The heater 255 is installed in a position opposing the pressure application roller 252 through the fuser belt 251. Note that the pressure application roller 252 is a specific example corresponding to the "second rotation member" of this invention.

The lever member 257 has its base end attached to the base part 250 in a rotatable manner centering on a shaft 257P. A tip part 257S of the lever member 257 and a tip part 250S of the base part 250 are elastically connected by the bias member 258 such as a coil spring. The bias member 258 biases the tip part 257S so as to bring the tip part 257S closer to the tip part 250S, that is, in the direction indicated with an arrow Y258 in FIG. 25B. Furthermore, the lever member 257 has a contact part 257T that comes into contact with the pressure application member 254.

As shown in FIG. 26A, the holding member 253 is an object of an approximate rectangular parallelopiped shape extending in the width direction (X-axis direction), and for example, has substantially the same dimension as the fuser belt 251 in the width direction. The holding member 253 is fixed to the pair of flanges 256L and 256R. Therefore, the holding member 253, the pair of flanges 256L and 256R, the lever member 257, and the fuser belt 251 are integrally displaced relative to the pressure application roller 252 supported by the base part 250. As shown in FIG. 26A, the holding member 253 includes a lubricant holding part 531 that is a concave part to hold the lubricant GR, an outer face 532, and at least one pathway 533 running from the lubricant holding part 531 to the outer face 532. The lubricant GR held in the lubricant holding part 531 moves to the outer face 532 via this pathway 533 when a pressure is applied by the pressure application member 254. Also, the pathway 533 includes a first end part T1 exposed to the lubricant holding part 531, and a second end part T2 exposed to the outer face 532. Here, in the rotation direction of the fuser belt 251 (the direction of the arrow R251), the rotation angle from the second end part T2 to the contact part between the outer face 532 and the pressure application roller 252 (that is, the nip part NP) should desirably be less than 180 degrees. That is, the second end part T2 through which the lubricant GR is ejected should desirably be immediately before the nip part NP in the rotation direction of the fuser belt 251. On the opposite side of the lubricant holding part 531, the holding member 253 further has a heater holding part 534 that holds the heater 255. Furthermore, in the vicinity of the pathway 533 on the outer face 532 of the holding member 253, an application amount adjusting part 535 is installed. This application amount adjusting part 535 communicates with the second end part T2 of the pathway 533, and extends in the width direction (X-axis direction). Therefore, the lubricant GR flowing out to the outer face 532 from the pathway 533 spreads in the width direction and is temporarily stored. Note that the pathway 533 should also better extend in the width direction. Alternatively, a plurality of the pathway 533 can be installed discretely at prescribed intervals in the width direction for example. In that case, the application amount adjusting part 535 should better be installed commonly to the plurality of the pathway 533. That is, it should better communicate with the second end part T2 of each of the plurality of the pathway 533.

As shown in FIG. 27, the pressure application member 254 is an object of an approximate rectangular parallelopiped shape extending in the width direction, and has substantially the same dimension as the fuser belt 251 in the width direction for example. The pressure application member 254 is installed in a displaceable manner along the Y-axis direction relative to the holding member 253. The pressure application member 254 has, for example, a pressure application part 541 that is inserted to the lubricant holding part 531 of the holding member 253, comes into contact with the lubricant GR held in the lubricant holding part 531, and applies a pressure to it, and a lock part 542 that is locked to a wall part surrounding the lubricant holding part 531. The pressure application member 254 further has a back face 543 that comes into contact with the contact part 257T of the lever member 257. By the back face 543 coming into contact with the contact part 257T of the lever member 257 and being biased in the —Y direction by the bias force of the bias member 258, the pressure application member 254 is displaced so as to approach the holding member 253.

A lubricant supply part including the holding member 253 and the pressure application member 254 supplies the lubricant GR via the pathway 533 from the holding member 253 into a space between the inner circumferential face 511 of the fuser belt 251 and the heater 255.

The heater 255 is a planar member of an approximate rectangular parallelopiped shape that applies heat to the fuser belt 251, and includes a heat generating body that is controlled by the fusing controller 790. The heat generating body is, for example, a resister line that generates heat by an electric current supply. As shown in FIGS. 28 and 29, the heater 255 includes a pressing face 255T that opposes and comes in contact with the inner circumferential face 511 of the fuser belt 251. The pressing face 255T presses the fuser belt 251 toward the pressure application roller 252, and is a specific example corresponding to the "first pressing face" of this invention. Also, the pressure application member 254 and the heater 255 are specific examples corresponding to the "first pressing member". Also, as shown in FIG. 29, a length Z11 along the carrying direction (Z-axis direction in FIG. 29) from the upstream side toward the downstream side in a first part 255T1 should desirably be larger than the difference Y11 (that is, the height of a step 255D1) between the first part 255T1 and a second part 255T2 in the thickness direction (Y-axis direction) perpendicular to the carrying direction (Z11>Y11). In the same manner, a length Z21 along the carrying direction (Z-axis direction in FIG. 29) from the upstream side toward the downstream side in a third part 255T3 should desirably be larger than the difference Y21 (that is, the height of a step 255D2) between a third part 255T3 and the second part 255T2 in the thickness direction (Y-axis direction) perpendicular to the carrying direction (Z21>Y21).

As shown in FIG. 29, the pressing face 255T includes the first part 255T1, the second part 255T2, and the third part 255T3 in this order from the upstream side toward the downstream side. To be detailed, the pressing face 255T includes the first part 255T1 positioned in its most upstream side, the second part 255T2 that is positioned in the downstream side of the first part 255T1 and protrudes more than the first part 255T1 toward the pressure application roller 252, and the third part 255T3 that is positioned in the downstream side of the second part 255T2 and is recessed more than the second part 255T2 away from the pressure application roller 252. Therefore, on the pressing face 255T, the step 255D1 between the first part 255T1 and the second part 255T2, and the step 255D2 between the second part 255T2 and the third part 255T3 exist.

Actions and Effects:

A. Operation of the Fuser Device 205

In the fuser device 205, the fusing process of a toner image onto the recording medium is performed by the control of the fusing controller 790 based on an instruction of the print controller 700 (see FIGS. 1A and 1B). Specifically, by the control of the fusing controller 790, while heat is applied to the fuser belt 251 with an electric current supplied to the heater 255, the fuser motor 793 is started to initiate the rotation of the pressure application roller 252. Accompanying the rotation of the pressure application roller 252, the fuser belt 251 in contact with it in the nip part NP also starts rotating by following it. Once the rotation of the fuser belt 251 is started, the lubricant GR pushed out from the second end part T2 into the space between the heater 255 and the inner circumferential face 511 of the fuser belt 251 moves in the circumferential direction along the inner circumferential face 511, and spreads in the width direction while being accumulated in the application amount adjusting part 535 for example. By the rotation of the fuser belt 251 being further continued, the lubricant GR is applied with nearly an uniform thickness over the entire inner circumferential face 511 in due time. As the result, by the action of a thin oil film formed by the lubricant GR, a frictional force occurring between the heater 255 and the inner circumferential face 511 of the fuser belt 251 is reduced. Therefore, slidability of the fuser belt 251 relative to the heater 255 is improved, stabilizing the rotation of the fuser belt 251.

Figure 30A:
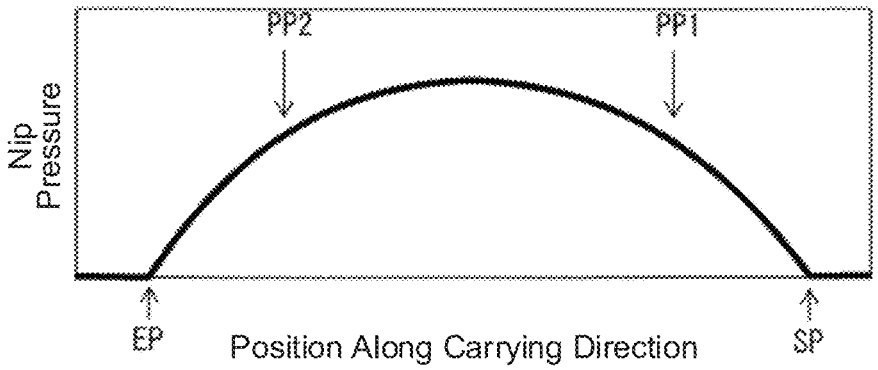
FIG. 30A is a characteristic diagram showing the distribution of a nip pressure along a medium carrying direction in the fuser device shown in FIG. 25A.

Next, referring to FIGS. 30A-30D in addition to FIGS. 25A-29, the distribution of the nip pressure along the carrying direction of the nip part NP is explained. FIG. 30A is a characteristic diagram showing the distribution along the medium carrying direction of the nip pressure applied to the recording medium passing through the nip part NP. In FIG. 30A, the horizontal axis indicates the position in the carrying direction (+Z direction here) of the nip part NP, and the vertical axis indicates the intensity of the nip pressure applied to the recording medium. In FIG. 30A, a start point SP is the position where the recording medium starts its entrance, that is the most upstream point of the nip part NP, and an end point EP indicates the position where the recording medium is ejected, that is the most downstream point of the nip part NP. Application of the nip pressure to the recording medium is started at the start point SP and ends at the end point EP. Therefore, the length from the start point SP to the end point EP is the length of the nip part NP in the carrying direction.

Figure 30B:
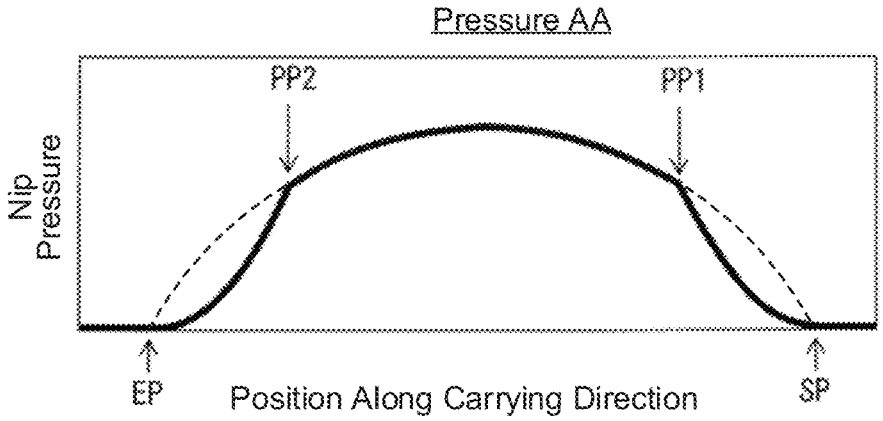
FIG. 30B is a characteristic diagram showing the distribution of a pressure component of the nip pressure shown in FIG. 30A.
Figure 30C:
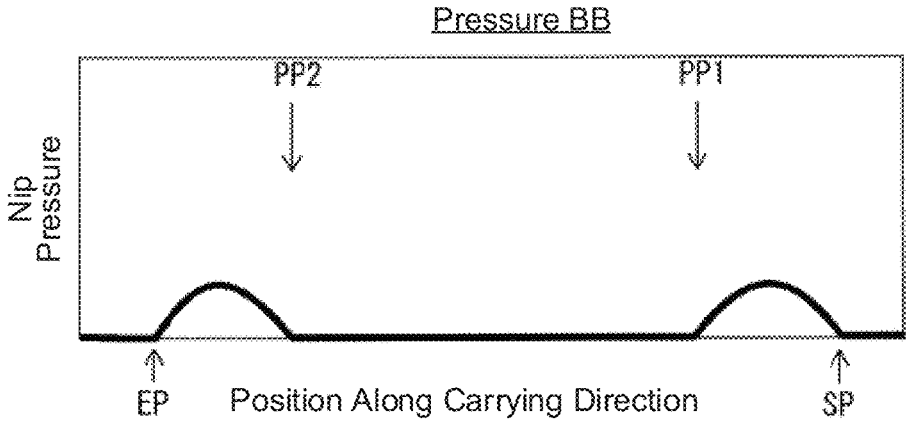
FIG. 30C is a characteristic diagram showing the distribution of another pressure component of the nip pressure shown in FIG. 30A.
Figure 30D:
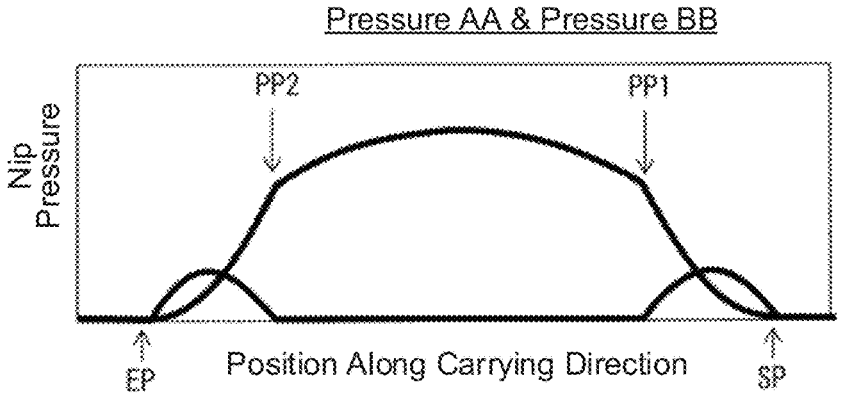
FIG. 30D is a characteristic diagram showing the superposition of the pressure component shown in FIG. 30B and the other pressure component shown in FIG. 30C.

As shown in FIG. 30A, in the fuser device 205, the nip pressure rises from the start point SP toward the downstream side as if drawing a moderate parabolic curve, and afterwards drops until reaching the end point EP. Here, the nip pressure shown in FIG. 30A is believed to be the synthesis of a pressure AA caused by the heater 255 and the pressure application roller 252, and a pressure BB caused by the fuser belt 251 and the pressure application roller 252. Then, by decomposing the nip pressure shown in FIG. 30A, the distribution of only the pressure AA is shown in FIG. 30B, the distribution of only the pressure BB is shown in FIG. 30C. Furthermore, the superposition of the variation curve of the pressure AA and the variation curve of the pressure BB is shown in FIG. 30D. In FIGS. 30B-30D, a position PP1 and a position PP2 indicated with arrows correspond to the positions of the step 255D1 and the step 255D2, respectively.

As shown in FIG. 30B, the pressure AA in the section from the start point SP to the position PP1 is slightly lower than an extension (shown in a broken line) of the parabolic curve showing the variation of the pressure AA in the section from the position PP1 to the position PP2. This is caused by the fact that relative to the second part 255T2 corresponding to the section from the position PP1 to the position PP2, the first part 255T1 and the third part 255T3 positioned respectively in its upstream and downstream sides are recessed away from the pressure application roller 252. On the other hand, as shown in FIG. 30C, while the pressure BB shows substantially 0 in the section from the position PP1 to the position PP2, it shows a small peak in both the section from the start point SP to the position PP1 and the section from the position PP2 to the end point EP. The reason is believed to be that in the vicinities of both ends in the carrying direction of the pressing face 255T of the heater 255, a pressing force mainly caused by the rigidity of the fuser belt 251 is applied somewhat strongly to the pressure application roller 252.

Figure 31:
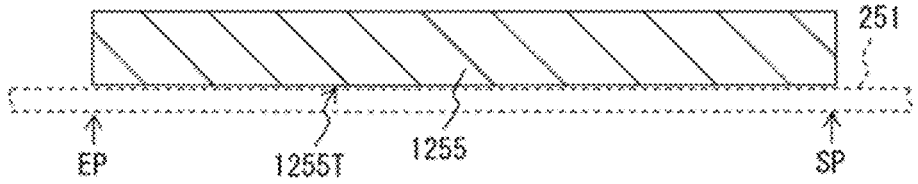
FIG. 31 is an enlarged cross-sectional view showing a heater as a reference example.
Figure 32A:
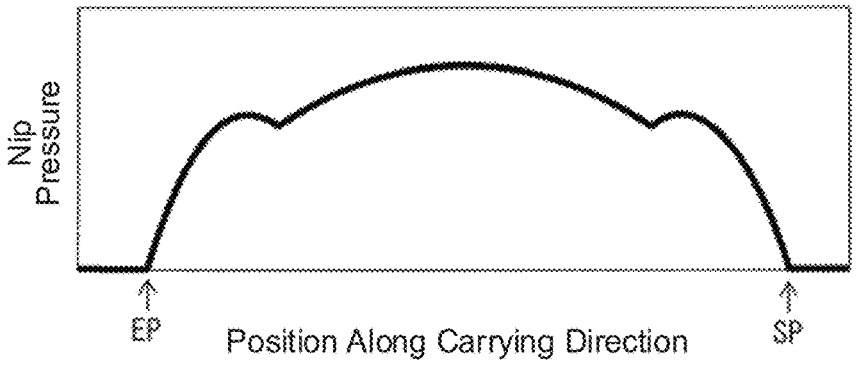
FIG. 32A is a characteristic diagram showing the distribution of the nip pressure along the medium carrying direction in the fuser device provided with the heater shown in FIG. 31.
Figure 32B:
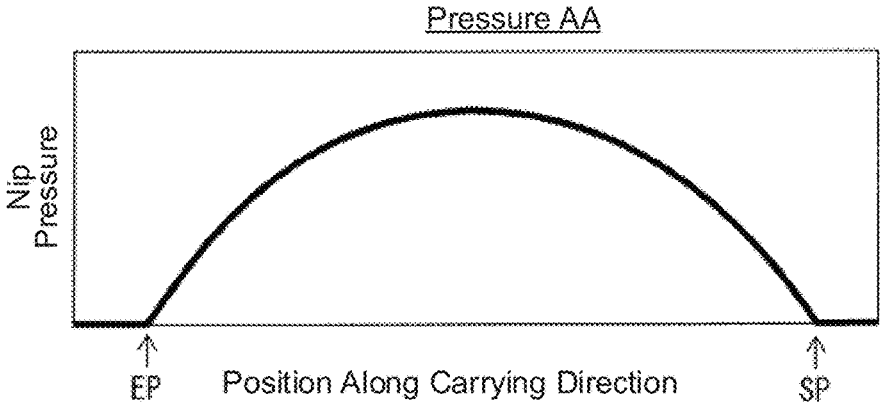
FIG. 32B is a characteristic diagram showing the distribution of a pressure component of the nip pressure shown in FIG. 32A.
Figure 32C:
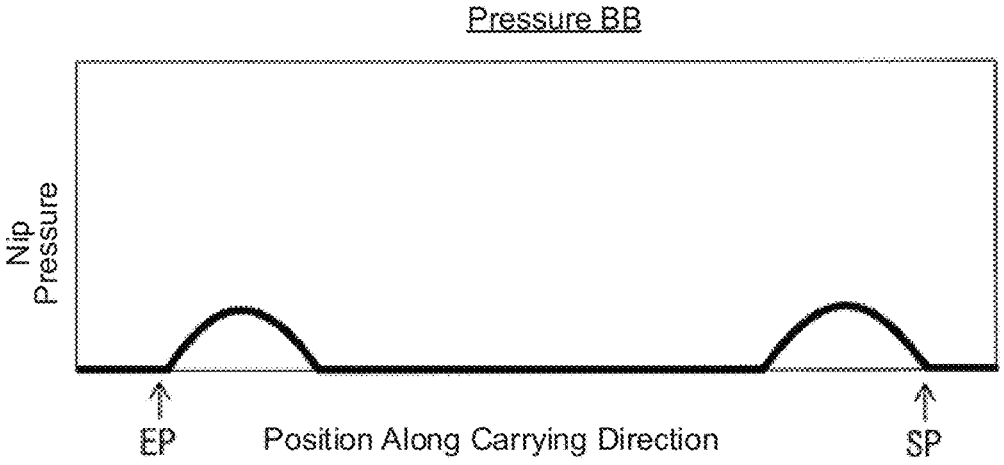
FIG. 32C is a characteristic diagram showing the distribution of another pressure component of the nip pressure shown in FIG. 32A.
Figure 32D:
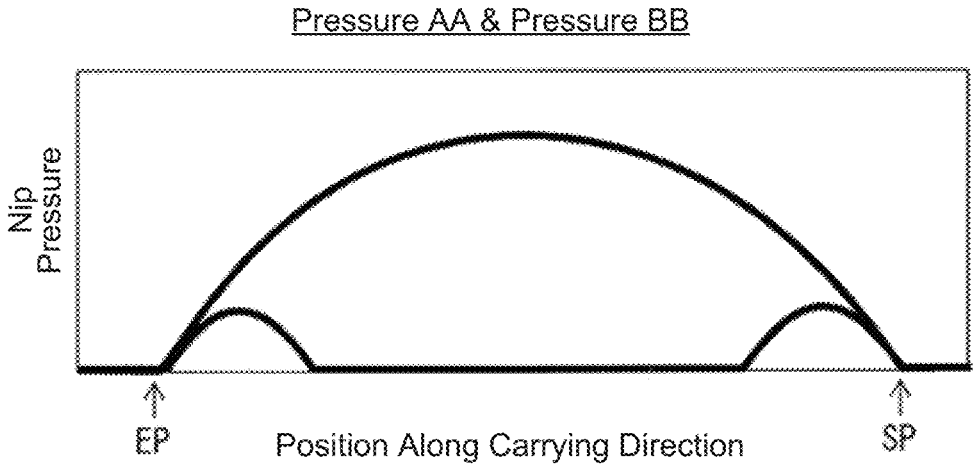
FIG. 32D is a characteristic diagram showing the superposition of the pressure component shown in FIG. 32B and the other pressure component shown in FIG. 32C.

As opposed to this, as in the case of a heater 1255 as a reference example shown in FIG. 31, if a flat pressing face 1255T is used, the nip pressure in the fuser device shows distributions shown in FIGS. 32A-32D for example. FIG. 32A corresponds to FIG. 30A, and shows the distribution, along the carrying direction of the recording medium, of the nip pressure applied to the recording medium passing through the nip part NP when the heater 1255 with the flat pressing face 1255T is used. In this case, a peak of the nip pressure is seen in the vicinities of both ends in the carrying direction of the pressing face 1255T of the heater 1255, that is in positions corresponding to immediately after the start point SP and immediately before the end point EP. FIG. 32B corresponds to FIG. 30B, and shows only the pressure AA of the nip pressure shown in FIG. 32A. FIG. 32C corresponds to FIG. 30C, and shows only the pressure BB of the nip pressure shown in FIG. 32A. FIG. 32D corresponds to FIG. 30D, and is the superposition of the variation curve of the pressure AA shown in FIG. 32B and the variation curve of the pressure BB shown in FIG. 32C.

Based on comparison between FIGS. 30A-30D and FIGS. 32A-32D, it is evident that by adopting the pressing face 255T where the steps 255D1 and 255D2 are installed, protrusions of the nip pressure in the section from the start point SP to the position PP1 and the section from the position PP2 to the end point EP can be relaxed. Therefore, if the fuser device 205 of this embodiment is used, a stable nip pressure having relatively small variation from the start point SP to the end point EP can be obtained. Therefore, it is expected that a decline in the fusing rate and image deficiencies can be avoided.

B. Effects

In this manner, in the fuser device 205, the steps 255D1 and 255D2 are installed on the pressing face 255T of the heater 255 that biases the fuser belt 251 to the pressure application roller 252. Therefore, the nip pressure in the initial stage of the fusing operation is relaxed. Because a rise of the nip pressure immediately after the recording medium entered the fuser device 205 is suppressed, the occurrence of so-called an image shift can be sufficiently avoided. Furthermore, because the rise of the nip pressure in the initial stage after the recording medium entered the nip part NP can be relaxed, a rapid decline of the nip pressure immediately afterwards can also be relaxed. For such a reason also, the fuser device 205 of this embodiment is preferable in avoiding the occurrence of image shifts.

Also, in the fuser device 205 of this embodiment, a first pressure application direction for the pressure application member 254 to apply a pressure to the lubricant GR and a second pressure application direction for the heater 255 and the fuser belt 251 to apply a pressure to the pressure application roller 252 are both the −Y direction, substantially coinciding with each other. Therefore, the structure that applies a force to them can be shared, thus the whole configuration can be simplified, which is appropriate for miniaturization and weight reduction. Especially, in the fuser device 205, by utilizing the bias force of the bias member 258, the pressure application to the lubricant GR by the pressure application member 254 and the pressure application to the pressure application roller 252 by the heater 255 and the fuser belt 251 are performed together in an interlocking manner, realizing even more simplification of the configuration.

5. Other Modifications

Although this invention was explained citing several embodiments and modifications above, this invention is not limited to the above-mentioned embodiments, but various kinds of modifications are possible. For example, although an image forming apparatus that forms a color image was explained in the above-mentioned embodiments, this invention is not limited to it but can be an image forming apparatus that forms a monochromatic image by transferring only a black toner image for example. Also, although an image forming apparatus of the primary transfer system (direct transfer system) was explained in the above-mentioned embodiments, this invention can be applied to the secondary transfer system.

Also, although steps were installed only on the pressing face of the pressure application pad positioned below in the first embodiment mentioned above, steps can be installed only on the pressing face of the fuser pad positioned above. Alternatively, steps can be installed on both the pressing face of the pressure application pad and the pressing face of the fuser pad. Also, although the pressure application belt 44 was illustrated as a specific example corresponding to the "first rotation member" of this invention, and the fuser belt 43 was illustrated as a specific example corresponding to the "second rotation member" of this invention in the first embodiment mentioned above, this invention is not limited to these. That is, this invention is a concept that also includes a case where the fuser belt 43 is a specific example corresponding to the "first rotation member" of this invention, and the pressure application belt 44 is a specific example corresponding to the "second rotation member" of this invention.

Also, although illustrated in the first embodiment mentioned above as three operation modes in the fuser device 105 were the normal print mode (normal pressure mode), the special print mode (reduced pressure mode), and the standby mode (separation mode), this invention is not limited to these. For example, the press-contact force in the reduced pressure mode can be further divided. For example, a mode where the fuser pad 51 and the pressure application pad 56 are separated while bringing the fuser roller 19 and the pressure application roller 20 into contact can be added.

Also, although the LED head having light emitting diodes as a light source was used as the exposure device in the above-mentioned embodiments, for example, the exposure device having laser elements or the like as a light source can be used.

Furthermore, although an image forming apparatus having a print function was explained as a specific example of the "image forming apparatus" of this invention in the above-mentioned embodiments, etc., this invention is not limited to it. That is, this invention can also be applied to an image forming apparatus that functions as a multifunction peripheral having a scan function and a facsimile function in addition to such a print function for example. With resect to the first and second pressing members discussed above, these members are embodied in various shapes, size, or structures as long as generating and providing proper pressure. For example, one or both of the members may be a roller or rollers.

What is claimed is:

1. A fuser device carrying a medium in a medium carrying direction, the medium having two faces wherein one of the faces is a print face on which a developer image is fused with the fuser device, and the other of the faces is a back face on which no developer image is fused, comprising:

a first rotation member that is an endless belt and has flexibility, a second rotation member that is an endless belt, has flexibility, and is installed rotatable so as to carry the medium from an upstream side to a downstream side in the medium carrying direction in cooperation with the first rotation member while nipping the medium between the second rotation member and the first rotation member wherein the print face of the medium faces the second rotation member and the back face of the medium faces the first rotation member while the medium is carried on a carrying path through the first and second rotation members, a first pressing member that is positioned inside the first rotation member and has a first pressing face pressing the first rotation member toward the second rotation member, and a second pressing member that is positioned inside the second rotation member and has a second pressing face, arranged to be opposite to the first pressing face with respect to the carrying path, the second pressing face pressing the second rotation member toward the first rotation member, wherein the first pressing face has, at the most upstream side of the medium carrying direction, a pressure reducing part that reduces a pressing force of the first rotation member that is applied to the second rotation member, and the second pressing face does not have a pressure reducing part that reduces a pressing force of the second rotation member that is applied to the first rotation member.

2. The fuser device according to claim 1, wherein the pressure reducing part has a first part and a second part, and the second part is positioned in the downstream side with respect to the first part and protrudes more than the first part toward the second rotation member such that the second part creates a step with the first part.

3. The fuser device according to claim 2, wherein the first pressing member has a sloped face that connects the first part and the second part.

4. The fuser device according to claim 2, wherein the first pressing member further has a third part that is positioned in the downstream side of the second part in the medium carrying direction, and the third part is farther from the second rotation member than the second part is.

5. The fuser device according to claim 2, wherein a length of the first part that is determined along the medium carrying direction from the upstream side toward the downstream side is larger than a difference between the first part and the second part in a thickness direction perpendicular to the medium carrying direction.

6. The fuser device according to claim 1, wherein the first rotation member and the second rotation member are metallic belts.

7. The fuser device according to claim 1, wherein the first pressing member has a rigid member and an elastic layer disposed on the rigid member.

8. An image forming apparatus, comprising:

an image forming unit that performs an image forming process through which a latent image is developed with a developer, the developed image being formed on the print face of the medium, the fuser device according to claim 1 with which the developed image is fused on the print face of the medium.

9. The fuser device according to claim 1, wherein a medium carrying path is determined between the first and second rotation members, the medium being carried along the medium carrying path in the medium carrying direction, the pressure reducing part formed on the first pressing member is positioned below the medium carrying path with respect to the gravity.

10. The fuser device according to claim 1, wherein the first pressing member is a pad, and the first pressing face of the first pressing member, which presses the first rotation member, is in a flat shape.

11. The fuser device according to claim 1, wherein the second pressing member is a pad, and the second pressing face of the second pressing member, which presses the second rotation member, is in a flat shape.

12. The fuser device according to claim 11, wherein the second pressing member is a pad, the second pressing face of the second pressing member, which presses the second rotation member, is in a flat shape, and the first pressing face of the first pressing member is arranged parallel to the second pressing face of the second pressing member.

13. The fuser device according to claim 1, wherein the second pressing member is physically independent from the second rotation member such that the second pressing member is stable while the second rotation member rotates.

* * * * *